United States Patent [19]

Saitoh et al.

[11] Patent Number: 4,666,807

[45] Date of Patent: May 19, 1987

[54] PHOTOCONDUCTIVE MEMBER

[75] Inventors: Keishi Saitoh, Ibaraki; Yukihiko Ohnuki, Kawasaki; Shigeru Ohno, Yokohama, all of Japan

[73] Assignee: Canon Kabushiki Kaisha, Tokyo, Japan

[21] Appl. No.: 814,017

[22] Filed: Dec. 20, 1985

Related U.S. Application Data

[63] Continuation of Ser. No. 686,938, Dec. 27, 1984, abandoned.

[30] Foreign Application Priority Data

| | | | |
|---|---|---|---|
| Dec. 29, 1983 | [JP] | Japan | 58-250270 |
| Dec. 30, 1983 | [JP] | Japan | 58-246524 |
| Jan. 4, 1984 | [JP] | Japan | 59-173 |

[51] Int. Cl.[4] ..... G03G 5/082; G03G 5/14

[52] U.S. Cl. ..... 430/58; 430/57; 430/60; 430/66; 430/67

[58] Field of Search ..... 430/57, 58, 60, 66, 430/67

[56] References Cited

U.S. PATENT DOCUMENTS

| | | | |
|---|---|---|---|
| 4,378,417 | 3/1983 | Maruyama et al. | 430/57 |
| 4,471,042 | 9/1984 | Komatsu et al. | 430/66 X |
| 4,490,450 | 12/1984 | Shimizu et al. | 430/95 X |
| 4,491,626 | 1/1985 | Kawamura et al. | 430/95 X |
| 4,495,262 | 1/1985 | Matsuzaki et al. | 430/95 X |
| 4,513,073 | 4/1985 | Jeffrey et al. | 430/65 |

FOREIGN PATENT DOCUMENTS

| | | | |
|---|---|---|---|
| 58-187939 | 11/1983 | Japan | 430/57 |

*Primary Examiner*—Roland E. Martin

*Attorney, Agent, or Firm*—Fitzpatrick, Cella, Harper & Scinto

[57] ABSTRACT

A light-receiving member comprises a substrate for light-receiving member and a light-receiving layer having photoconductivity provided on said substrate, said light-receiving layer comprising from the side of said substrate a first layer (I) comprising an amorphous material containing silicon atoms, a second layer (II) comprising an amorphous material containing silicon atoms and germanium atoms and a third layer (III) comprising an amorphous material containing silicon atoms and nitrogen atoms, and the germanium atoms contained in said second layer (II) being distributed ununiformly in the layer thickness direction of said layer.

51 Claims, 23 Drawing Figures

PHOTOCONDUCTIVE MEMBER

This application is a continuation of application Ser. No. 686,938 filed Dec. 27, 1984 now abandoned.

BACKGROUND OF THE INVENTION

1. Field of the Invention

This invention relates to a light-receiving member having sensitivity to electromagnetic waves such as light (herein used in a broad sense, including ultraviolet rays, visible light, infrared rays, X-rays, gamma-rays, and the like).

2. Description of the Prior Art

Photoconductive materials, which constitute photoconductive layers in solid state image pickup devices, image forming members for electrophotography in the field of image formation, or manuscript reading devices and the like, are required to have a high sensitivity, a high SN ratio [photocurrent ($I_p$)/dark current ($I_d$)], spectral characteristics matching to those of irradiating electromagnetic waves, a rapid response to light, a desired dark resistance value as well as no harm to human bodies during usage. Further, in a solid state image pick-up device, it is also required that the residual image should easily be treated within a predetermined time. Particularly, when an image forming member for electrophotography is assembled in an electrophotographic device as an office apparatus, said harmless characteristic is very important.

Under these circumstances, amorphous silicon (hereinafter referred to as "a-Si") has recently attracted attention as a photoconductive material. For example, German OLS Nos. 2746967 and 2855718 disclose applications of a-Si to image forming members for electrophotography, and German OLS No. 2933411 discloses an application of a-Si to a photoelectric transducing reading device.

However, under the present situation, the photoconductive members of the prior art having photoconductive layers made of a-Si still require further improvement in a balance of overall characteristics including electrical, optical and photoconductive characteristics such as dark resistance value, photosensitivity and response to light, etc., and service environmental characteristics such as humidity resistance, and a longer stability.

For instance, when said photoconductive member is applied to an image forming member for electrophotography, residual potential frequently remains on it during the service time if a higher photosensitivity and a higher dark resistance are made at the same time. When such a photoconductive member is repeatedly used for a long time, various inconveniences often appear, such as accumulation of fatigues by repeated uses or so called ghost phenomenon wherein residual images are formed, or when the photoconductive member is used repeatedly at a high speed, the response is gradually lowered.

Further, a-Si has a relatively smaller coefficient of absorption of the longer wavelength light in the visible light region as compared with the shorter wavelength light. Accordingly, in the matching to the semiconductor laser now practically used, the longer wavelength light cannot effectively be utilized, when the ordinary halogen lamp or fluorescent lamp is used as the light source. Thus, there still remain various points to be improved.

On the other hand, when the irradiation light is not sufficient absorbed in the photoconductive layer, but when the amount of the light reaching the substrate is increased, interference due to multiple reflection may occur in the photoconductive layer to cause an "unfocused" image, in the case that the substrate itself has a high reflectance to the light transmitted through the photoconductive layer.

This effect will be increased, if the irradiated spot is made smaller to enhance resolution. Thus, this will be a great problem when a semiconductor laser is used as the light source.

Further, a-Si materials for the photoconductive layer may contain as the constituent atoms hydrogen atoms or halogen atoms such as fluorine atoms, chlorine atoms, etc. for improving their electrical, photoconductive characteristics; boron atoms, phosphorus atoms, etc. for controlling the electroconduction type as well as other atoms for improving other characteristics. The manner in which these constituent atoms exist therein may sometimes raise problems of electrical or photoconductive characteristics of the formed layer.

In many cases, for example, the life of the photocarriers generated by light irradiation in the formed photoconductive layer is not sufficiently long, or the charges injected from the substrate side cannot be sufficiently prevented at the dark portion.

Accordingly, together with an attempt to improve the characteristics of a-Si material itself, it is also required to overcome all the problems as mentioned above in designing of the photoconductive member at the same time.

The present invention is based results of extensive studies made comprehensively from the standpoints of applicability and utility of a-Si as a light-receiving member for image forming members for electrophotography, solid state image pick-up devices, reading devices, etc. It has now been found that the light-receiving member constituted of an amorphous material containing silicon atom (Si) as a matrix, especially, an amorphous material containing at least one of hydrogen atom (H) and halogen atom (X) in a matrix of silicon atom (Si), so-called hydrogenated amorphous silicon, halogenated amorphous silicon, or halogen-containing hydrogenated amorphous silicon [hereinafter referred to comprehensively as "a-Si(H,X)"] and an amorphous material containing silicon atom (Si) and germanium atom (Ge) as a matrix, especially, an amorphous material containing at least one of hydrogen atom (H) and halogen atom (X) in a matrix of silicon atom (Si) and germanium atom (Ge), so-called hydrogenated amorphous silicon germanium, halogenated amorphous silicon germanium, or halogen-containing hydrogenated amorphous silicon germanium [hereinafter referred to comprehensively as "a-SiGe(H,X)"], said light-receiving member being prepared with a design to have a specific structure as hereinafter described, not only exhibits practically extremely excellent characteristics but also surpasses the light-receiving members of the prior art in substantially all respects especially having markedly excellent characteristics as the light-receiving member for electrophotography and also excellent absorption spectrum characteristics on the longer wavelength side.

SUMMARY OF THE INVENTION

A primary object of the present invention is to provide a light-receiving member having electrical, optical and photoconductive characteristics which are constantly stable and all-environment type with virtually no dependence on the environments under use, which member is markedly excellent in light fatigue resistance and also excellent in durability without causing deterioration phenomenon when used repeatedly, exhibiting no or substantially no residual potential observed.

Another object of the present invention is to provide a light-receiving member which is high in photosensitivity throughout the whole visible light region, particularly excellent in matching to a semiconductor laser and also rapid in light response.

Still another object of the present invention is to provide a light-receiving member having excellent electrophotographic property and sufficient charge retentivity during charging treatment for formation of electrostatic images to the extent such that a conventional electrophotographic method can be very effectively applied when it is provided for use as an image forming member for electrophotography.

Further, still another object of the present invention is to provide a light-receiving member for electrophotography, which can easily provide an image of high quality which is high in density, clear in halftone and high in resolution without formation of image defect or image flow.

Still another object of the present invention is to provide a light-receiving member, capable of giving sufficiently high dark resistance and sufficient receptor potential, and also to improve productivity through improvement of adhesion between respective layers.

Still another object of the present invention is to provide a light-receiving member having high photosensitivity and high SN ratio characteristic.

Further, still another object of the present invention is to provide a light-receiving member comprising a substrate for the light-receiving member and a light-receiving layer having photoconductivity provided on said substrate, said light-receiving layer comprising from the side of said substrate a first layer (I) comprising an amorphous material containing silicon atoms, a second layer (II) comprising an amorphous material containing silicon atoms and germanium atoms and a third layer (III) comprising an amorphous mateiral containing silicon atoms and nitrogen atoms, and the germanium atoms contained in said second layer (II) being distributed ununiformly in the layer thickness direction of said layer.

DETAILED DESCRIPTION OF THE PREFERRED EMBODIMENTS

Figure 1:
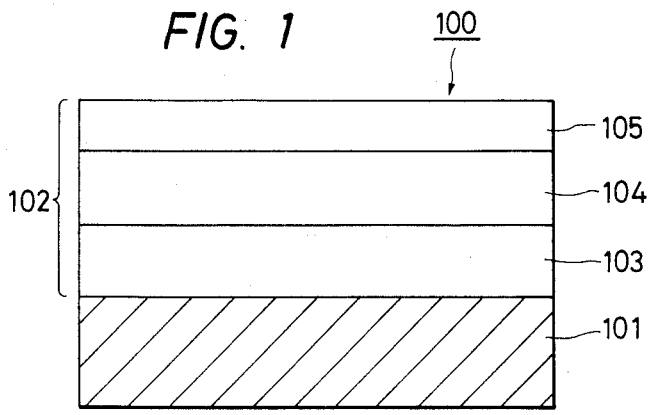
FIG. 1 shows a schematic view for illustration of the layer constitution of the light-receiving member according to the present invention.

Referring now to the drawings, the photoconductive member of the present invention is to be described in detail.

FIG. 1 shows schematically the layer constitution of the light-receiving member of the present invention.

The light-receiving member 100 of the present invention has a light-receiving layer 102 having sufficient volume resistance and photoconductivity on a substrate 101 for light-receiving member. The light-receiving layer 102 is constituted, from the aforesaid substrate side, of a first layer (I) 103 comprising a-Si(H,X), a second layer (II) 104 comprising a-SiGe(H,X) and a third layer (III) 105 comprising a-SiN(H,X). Although photoconductivity may be possessed by either one of the first layer (I) and the second layer (II), it is anyway necessary to design the layer so that the layer which the incident light reaches may have photoconductivity. Also, in this case, it is desirable that both of the first layer (I) and the second layer (II) should have photoconductivity to the light having respectively desirable wavelength spectra, and that the layer should be designed so as to be able to generate sufficient amount of photocarriers.

For more effectively achieving the objects of the present invention, it is desirable that at least one of the first layer (I) and the second layer (II) contain hydrogen atoms and/or halogen atoms and also that at least one of the first layer (I) and the second layer (II) contain a substance for controlling conductivity.

In the light-receiving member of the present invention, by incorporating a substance (C) for controlling conductivity in at least one of the first layer (I) and the second layer (II), the conductivity of the layer containing it can be controlled as desired. Said substance (C) may be contained in both or each of the first layer (I) and the second layer (II) either uniformly or ununiformly in the layer thickness direction. Also, in the layer region (PN) where the substance (C) is contained, the substance (C) may be contained continuously, either uniformly or ununiformly in the layer thickness direction.

For example, when the layer thickness of the second layer (II) is made thicker than the first layer (I), in order to employ the second layer (II) so as to have the function of charge generating layer and the charge transporting layer, the substance (C) for controlling conductivity should desirably be contained in the first layer (I) in a distribution to be enriched on the substrate side. On the other hand, the substance (C) for controlling conductivity should desirably be contained in the second layer (II) so that it is more enriched on the interface between the first layer (I) and the second layer (II) or in the vicinity of the interface.

On the other hand, when the first layer (I) is made thicker in layer thickness than the second layer (II), in order to make the function of the second layer (II) that of the charge generating layer and also to make the function of the first layer (I) that of the charge transporting layer, it is desirable that the substance (C) for controlling conductivity should be contained so as to be more enriched on the substrate side of the first layer (I).

Thus, in the present invention, by providing a layer region (PN) containing a substance (C) for controlling conductivity continuously in the layer thickness direction in at least one of the first layer (I) and the second layer (II), it is possible to effect improvement to higher sensitivity and higher dielectric strength.

As a substance (C) for controlling conductivity characteristics, there may be mentioned so called impurities in the field of semiconductors. In the present invention, there may be included p-type impurities giving p-type conductivity characteristics and n-type impurities giving n-type conductivity characteristics to Si or Ge. More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga. As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the layer region (PN) provided in the light-receiving layer may be suitably be selected depending on the conductivity required for said layer region (PN), or when said layer region (PN) is provided in direct contact with the substrate, depending on the organic relationships such as relation with the characteristics at the contacted interface with the substrate, etc. Also, the content of the substance (C) for controlling conductivity is determined suitably with due considerations of the relationships with characteristics of other layer regions provided in direct contact with said layer region (PN) or the characteristics at the contacted interface with said other layer regions.

In the present invention, the content of the substance (C) for controlling conductivity contained in the layer region (PN) should preferably be 0.001 to $5\times10^4$ atomic ppm, more preferably 0.5 to $1\times10^4$ atomic ppm, most preferably 1 to $5\times10^3$ atomic ppm.

In the present invention, by making the content of the substance (C) for controlling conductivity in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to ⊕ polarity. On the other hand, when the substance (C) to be incorporated is a n-type impurity, migration of positive holes injected from the substrate side into the light-receiving layer can be effectively inhibited when the free surface of the light-receiving layer is subjected to the charging treatment to ⊖ polarity.

In the case as mentioned above, the layer region (Z) at the portion excluding the above layer region (PN) may contain a substance for controlling conductivity of the other polarity than that of the substance (C) for controlling conductivity contained in the layer region (PN), or a substance for controlling conductivity characteristics of the same polarity may be contained therein in an amount by far smaller than that practically contained in the layer region (PN).

In such a case, the content of the substance (C) for controlling conductivity contained in the above layer region (Z) can be determined adequately as desired depending on the polarity or the content of the substance (C) contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance (C) for controlling conductivity is contained in the layer region (PN) and the layer region (Z), the content in the layer region (Z) should preferably be 30 atomic ppm or less. As different from the cases as mentioned above, in the present invention, it is also possible to provide a layer region containing a substance for controlling conductivity having one polarity and a layer region containing a substance for controlling conductivity having the other polarity in direct contact with each other, thus providing a so called depletion layer at said contact region. In short, for example, a layer containing the aforesaid p-type impurity and a layer region containing the aforesaid n-type impurity are provided in the light-receiving layer in direct contact with each other to form the so called p-n junction, whereby a depletion layer can be provided.

In the present invention, illustrative of halogen atoms (X), which may optionally be incorporated in the first layer (I) are fluorine, chlorine, bromine and iodine, particularly preferably fluorine and chlorine.

In the present invention, formation of the first layer (I) constituted of a-Si(H,X) may be conducted according to the vacuum deposition method utilizing discharging phenomenon, such as glow discharge method, sputtering method or ion-plating method.

For example, for formation of the first layer (I) constituted of a-Si(H,X) according to the glow discharge method, the basic procedure comprises introducing a starting gas for Si supply capable of supplying silicon atoms (Si), and a starting gas for introduction of hydrogen atoms (H) and/or a starting gas for introduction of halogen atoms (X) into a deposition chamber which can be internally brought to a reduced pressure at a prescribed mixing ratio and gas flow rate, and exciting glow discharge in said deposition chamber, thereby effecting layer formation of the first layer (I) constituted of a-Si(H,X) on the surface of a substrate placed at a predetermined position. Alternatively, for formation according to the sputtering method, when carrying out sputtering by use of a target constituted of Si in an atmosphere of an inert gas such as Ar, He, etc. or a gas mixture based on these gases, a starting gas for Ge supply optionally together with, if desired, a gas for introduction of hydrogen atoms (H) and/or a gas for introduction of halogen atoms (X) may be introduced into a deposition chamber for sputtering.

In the present invention, as the effective starting materials for the starting gases to be employed for formation of the first layer (I), the following compounds may be included.

First, the starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the starting materials effectively used for supplying Si, in addition to hydrogenated silicon as mentioned above, there may be included silicon compounds containing halogen atoms (X), namely the so called silane derivatives substituted with halogen atoms, including halogenated silicon such as $SiF_4$, $Si_2F_6$, $SiCl_4$, $SiBr_4$, etc. as preferable ones. Further, halides containing hydrogen atom as one of the constituents, which are gaseous or gasifiable, such as halo-substituted hydrogenated silicon, including $SiH_2F_2$, $SiH_2I_2$, $SiH_2Cl_2$, $SiCHl_3$, $SiH_2Br_2$, $SiHBr_3$, etc. may also be mentioned as the effective starting materials for supplying Si for formation of the first layer (I).

Also, in the case of employing these silicon compounds containing halogen atoms (X), halogen atoms (X) can be introduced together with Si in the first layer (I) formed by suitable choice of the layer forming conditions as mentioned above.

Effective starting materials to be used as the starting gases for introduction of halogen atoms (X) in formation of the first layer (I) in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc.; and halogenated hydrogen such as HF, HCl, HBr, HI, etc.

For incorporating a substance (C) for controlling conductivity such as the group III atoms or the group V atoms structurally into the layer region constituting the first layer (I), a starting material for introduction of the group III atoms or a starting material for introduction of the group V atoms may be introduced under gaseous state into a deposition chamber together with the other starting materials for formation of the first layer (I) during layer formation. As the starting material which can be used for introduction of the group III atoms, it is desirable to use those which are gaseous at room temperature under atmospheric pressure or can readily be gasified under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PBr_5$, $PCl_3$, $PCl_5$, $PBr_3$, $PI_3$ and the like. Otherwise, it is also possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like effectively as the starting material for introduction of the group V atoms.

In the present invention, the content of the substance (C) for controlling conductivity in the first layer (I) may be suitably be selected depending on the conductivity required for said first layer (I), or characteristics of other layers provided in direct contact with said first layer (I), the organic relationships such as relation with the characteristics of said other layers at the contacted interface, etc.

In the present invention, the content of the substance (C) for controlling conductivity contained in the first layer (I) should preferably be 0.001 to $5\times10_4$ atomic ppm, more preferably 0.5 to $1\times10^4$ atomic ppm, most preferably 1 to $5\times10^3$ atomic ppm.

In the present invention, the amount of hydrogen atoms (H) or the amount of halogen atoms (X) or the sum of the amounts of hydrogen atoms and halogen atoms (H+X) which may be contained in the first layer (I) should preferably be 1 to 40 atomic %, more preferably 5 to 30 atomic %.

For controlling the amount of hydrogen atoms (H) and/or halogen atoms (X) which may be contained in the first layer (I), for example, the substrate temperature and/or the amount of the starting materials used for incorporation of hydrogen atoms (H) or halogen atoms (X) to be introduced into the deposition device system, discharging power, etc. may be controlled.

The first layer (I) of the present invention has a layer thickness which may suitable be determined as desired, depending on whether said first layer (I) acts primarily as the adhesion layer between the substrate and the second layer (II) or as the adhesion layer and the charge transporting layer. In the former case, it should desirably be 1000Å to 50 μm, more preferably 2000Å to 30 μm, most preferably 2000Å to 10 μm. In the latter case, it should desirably be 1 to 100 μm, more preferably 1 to 80 μm, most preferably 2 to 50 μm.

In the light-receiving member of the present invention, a second layer (II) 104 is formed on the first layer (I) 103. The first layer (I) and the second layer (II) each comprise amorphous materials both having the common constituent atom of silicon atom, and therefore chemical stability is sufficiently ensured at the laminated interface therebetween.

In the light-receiving member of the present invention, it is desirable that the germanium atoms contained in the second layer (II) should desirably take an ununiform distribution with respect to the layer thickness direction, but an uniform distribution with respect to the interplanar direction in parallel to the surface of the substrate.

By forming the second layer (II) so as to have such a layer structure, a light-receiving member can be formed, which is excellent in photosensitivity to the light in the whole wavelength region from relatively shorter wavelengths to relatively longer wavelengths, including visible light region.

Also, as to the distribution of germanium atoms in the second layer (II), it is possible to afford a layer constitution having a continuous distribution of germanium atoms throughout the whole region, for example, one in which the distribution concentration C of germanium atoms in the layer thickness direction is distributed so as to be reduced from the boundary with the first layer (I) toward the boundary with the third layer (III), one in which it is increased from the boundary with the first layre (I) toward the boundary with the third layer (III), or one in which both of these characteristics are possessed.

FIGS. 2 through 13 show typical examples of distribution in the direction of layer thickness of germanium atoms contained in the second layer (II) of the light-receiving member in the present invention.

In FIGS. 2 through 13, the abscissa indicates the distribution concentration C of germanium atoms and the ordinate the layer thickness of the seocnd layer (II), $t_B$ showing the position of the boundary surface between the first layer (I) and the second layer (II) and $t_T$ the position of the boundary surface between the second layer (II) and the third layer (III). That is, layer formation of the second layer (II) containing germanium atoms proceeds from the $t_B$ side toward the $t_T$ side.

Figure 2:
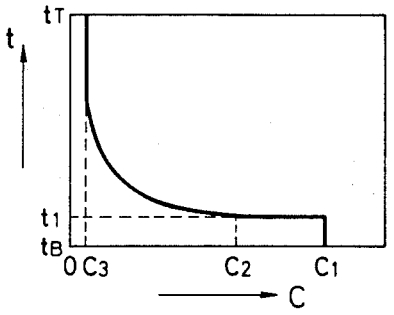
FIGS. 2 through 13 each shows a schematic illustration of the depth profile of germanium atoms in the second layer (2) in the light-receiving member of the present invention.

In FIG. 2, there is shown a first typical embodiment of the distribution concentration in the layer thickness direction (depth profile) of germanium atoms contained in the second layer (II).

In the embodiment as shown in FIG. 2, from the interface position $t_B$, with the first layer (I) at which the second layer (II) containing germanium atoms is to be formed, to the position $t_1$, germanium atoms are contained in the second layer (II) formed, while the concentration C of germanium atoms taking a constant value of $C_1$, the concentration being gradually decreased from the concentration $C_2$ continuously from the position $t_1$ to the interface position $t_T$ with the third layer (III). At the interface position $t_T$, the concentration C of germanium atoms is made $C_3$.

Figure 3:
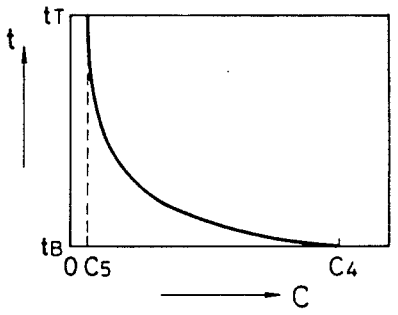

In the embodiment shown in FIG. 3, the concentration C of germanium atoms contained is decreased gradually and continuously from the position $t_B$ to the position $t_T$ from the concentration $C_4$ until it becomes the concentration $C_5$ at the position $t_T$.

Figure 4:
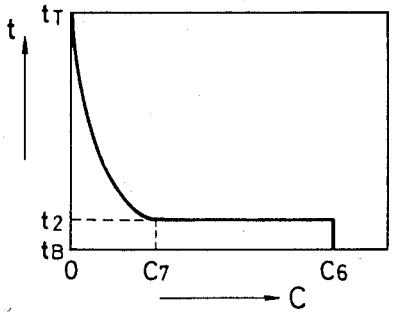

In case of FIG. 4, the concentration C of germanium atoms is made constant as $C_6$ from the position $t_B$ to the position $t_2$ gradually decreased continuously from the position $t_2$ to the position $t_T$ and the concentration C is made substantially zero at the position $t_T$ (substantially zero herein means the content less than the detectable limit).

Figure 5:
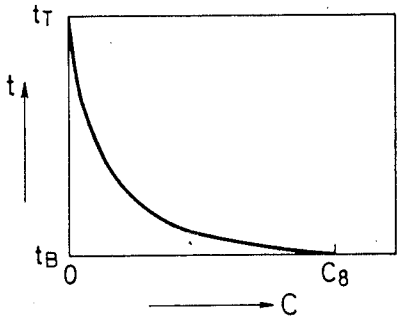

In case of FIG. 5, the concentration C of germanium atoms are decreased gradually and continuously from the position $t_B$ to the position $t_T$ from the concentration $C_8$, until it is made substantially zero at the position $t_T$.

Figure 6:
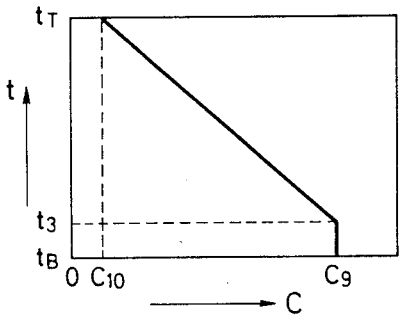

In the embodiment shown in FIG. 6, the concentration C of germanium atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 7:
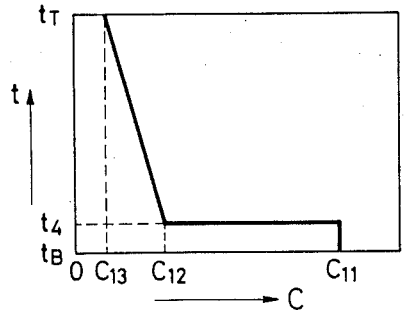

In the embodiment shown in FIG. 7, there is formed a depth profile such that the concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 8:
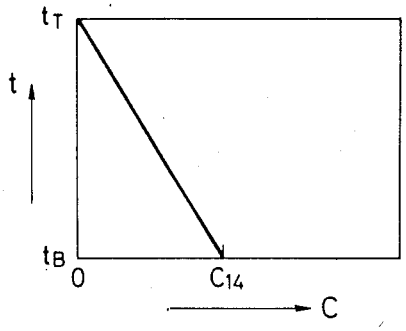

In the embodiment shown in FIG. 8, the concentration C of germanium atoms is decreased as a first order function from the concentration $C_{14}$ to substantially zero from the position $t_B$ to the position $t_T$.

Figure 9:
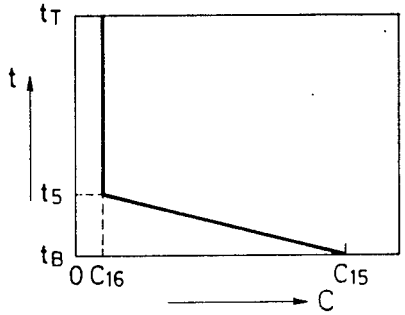

In FIG. 9, there is shown an embodiment, where the concentration C of germanium atoms is decreased as a first order function from the concentration $C_{15}$ to the concentration $C_{16}$ from the position $t_B$ to the position $t_5$ and made constantly at the concentration $C_{16}$ between the position $t_5$ and the position $t_T$.

Figure 10:
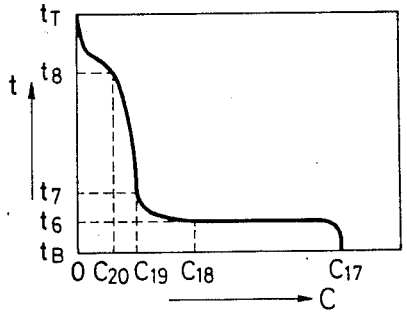

In the embodiment shown in FIG. 10, the concentration C of germanium atoms is at the concentration $C_{17}$ at the position $t_B$, which concentration is initially decreased gradually and then abruptly near the position $t_6$, until it is made the concentration $C_{18}$ at the position $t_6$.

Between the position $t_6$ and the position $t_7$, the concentration is initially decreased abruptly and thereafter gradually, until it is made the concentration $c_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

Figure 11:
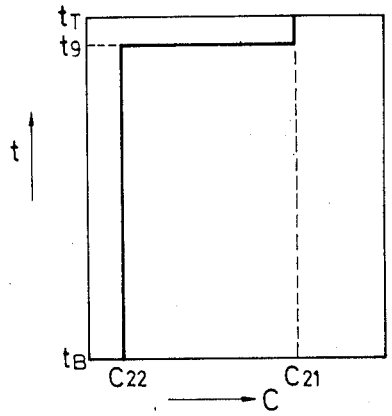

In the embodiment shown in FIG. 11, the germanium concentration is constantly $C_{22}$ from the position $t_B$ to the position $t_9$, and the germanium concentration C is made constantly $C_{21}$ from the position $t_9$ to the position $t_B$.

Figure 12:
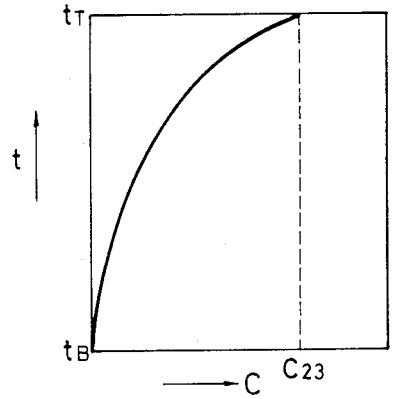

In the embodiment shown in FIG. 12, the germanium concentration is substantially zero at the position $t_B$, and the germanium concentration is increased along the curve as shown in the Figure so that it may become $C_{23}$ at the position $t_T$.

Figure 13:
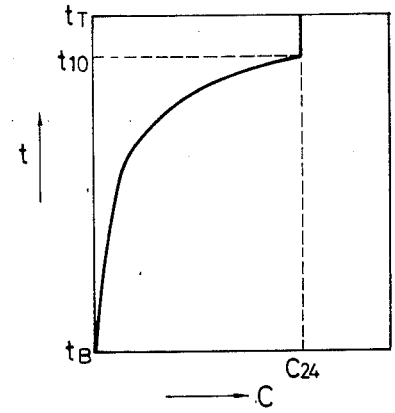

In FIG. 13, the germanium concentration is substantially zero at the position $t_B$, and the germanium concentration is increased along the curve as shown in the Figure from the position $t_B$ to the concentration $C_{24}$ at the position $t_{10}$, the germanium concentration being constantly $C_{24}$ from the position $t_{10}$ to the position $t_T$.

In the germanium depth profiles shown in FIGS. 2 through 13, the germanium concentration is enriched in the vicinity of the boundary interface with the first layer (I) in FIGS. 2 through 10, while the germanium concentration enriched in the vicinity of the boundary interface with the third layer (III) in FIGS. 1 through 13. It is also possible to use a combination of these germanium depth profiles.

As described above about some typical examples of depth profiles of germanium atoms contained in the second layer (II) in the direction of the layer thickness by referring to FIGS. 2 through 13, in the present invention, a portion with higher distribution concentration C of germanium atoms is possessed in the vicinity of the boundary interface with the first layer (I) and/or in the vicinity of the boundary interface with the third layer (III), while there is provided in the second layer (II) a distributed state of germanium atoms having a portion with considerably lower concentration as compared with the vicinity of the boundary interface with the first layer (I) and the vicinity of the boundary interface with the third layer (III).

The second layer (II) constituting the light-receiving layer of the light-receiving member in the present invention is desired to have a localized region (A) containing germanium atoms at a relatively higher concentration in the vicinity of the boundary interface with the first layer (I) and/or with the third layer (III) as described above.

In the present invention, the localized region (A), as explained in terms of the symbols shown in FIG. 2 through FIG. 13, may be desirably provided within 5 μm from the interface position $t_B$ or $t_T$.

In the present invention, the above localized region (A) may be made to be identical with the whole layer region ($L_T$) within 5 μm thickness from the interface position $t_B$ or $t_T$, or alternatively a part of the layer region ($L_T$).

It may suitably be determined depending on the characteristics required for the light-receiving layer to be formed, whether the localized region (A) is made a part or whole of the layer region ($L_T$).

The localized region (A) may preferably be formed according to such a layer formation that the maximum value Cmax of the concentration C of germanium atoms in a distribution in the layer thickness direction may preferably be 1000 atomic ppm or more, more preferably 5000 atomic ppm or more, most preferably $1\times10^4$ atomic ppm or more, based on silicon atoms.

That is, according to the present invention, the second layer (II) containing germanium atoms is formed so that the maximum value Cmax of the distributed concentration may exist within a layer thickness of 5 μm from the first layer (I) side or from the free surface of the second layer (II) (the layer region within 5μ thickness from $t_B$).

In the present invention, the content of germanium atoms in the second layer (II), which may suitably be determined as desired so as to achieve effectively the objects of the present invention, may preferably be 1 to $9.5\times10^5$ atomic ppm, more preferably 100 to $8\times10^5$ atomic ppm, most preferably 500 to $7\times10^5$ atomic ppm based on silicon atoms.

In the light-receiving member of the present invention, when the first layer (I)has a thin thickness, a layer region (PN) containing a substance (C) for controlling conductivity can be provided in the second layer (II) containing germanium atoms locally on the first layer (I) side, whereby said layer region (PN) can function as the so-called charge injection impeding layer.

That is, by making the content of the substance (C) for controlling conductivity in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to ⊕ polarity. On the other hand, when the substance (C) to be incorporated is a n-type impurity, migration of positive holes injected from the substrate side into the light-receiving layer can be effectively inhibited when the free surface of the light-receiving layer is subjected to the charging treatment to ⊖ polarity.

In the case as mentioned above, the layer region (ZII) at the portion excluding the above layer region (PN) in the second layer (II) may contain a substance (C) for controlling conductivity of the other polarity than that of the substance (C) for controlling conductivity contained in the layer region (PN), or a substance (C) for controlling conductivity characteristics of the same polarity may be contained therein in an amount by far smaller than that of the substance (C) practically contained in the layer region (PN).

In such a case, the content of the substance (C) for controlling conductivity contained in the above layer region (ZII) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance (C) for controlling conductivity is contained in the layer region (PN) and the layer region (ZII) the content in the layer region (ZII) should preferably be 30 atomic ppm or less. As different from the cases as mentioned above, in the present invention, it is also possible to provide in the second layer (II) a layer region containing a substance (C) for controlling conductivity having one polarity and a layer region containing a substance (C) for controlling conductivity having the other polarity in direct contact with each other, thus providing a so-called depletion layer at said contact region. In short, for example, a layer containing the aforesaid p-type impurity and a layer region containing the aforesaid n-type impurity are provided in the second layer (II) in direct contact with each other to form the so-called p-n junction, whereby a depletion layer can be provided.

In the present invention, illustrative of halogen atoms (X), which may optionally be incorporated in the the second layer (II) are fluorine, chlorine, bromine and iodine, particularly preferably fluorine and chlorine.

In the present invention, formation of the second layer (II) constituted of a-SiGe (H,X) may be conducted according to the vacuum deposition method utilizing discharging phenomenon, such as glow discharge method, sputtering method or ion-plating method.

For example, for formation of the second layer (II) constituted of a-SiGe(H,X) according to the glow discharge method, the basic procedure comprised introducing a starting gas for Si supply capable of supplying silicon atoms (Si), a starting gas for Ge supply capable of supplying germanium atoms (Ge) optionally together with a starting gas for introduction of hydrogen atoms (H) and/or a starting gas for introduction of halogen atoms (X) into a deposition chamber which can be internally brought to a reduced pressure at a desired pressure, and exciting glow discharge in said deposition chamber, thereby effecting layer formation on the surface of a substrate, on which the first layer (I) has been formed, placed at a predetermined position, while controlling the depth profile of germanium atoms according to a desired change rate curve to form the second layer (II) constituted of a-SiGe(H,X).

Alternatively, for formation according to the sputtering method, when carrying out sputtering by use of a target constituted of Si or two sheets of targets of said target and a target constituted of Ge, or a target of a mixture of Si and Ge in an atmosphere of an inert gas such as Ar, He, etc. or a gas mixture based on these gases, a starting gas for Ge supply diluted with an inert gas such as Ar, He, etc. optionally together with, if desired, a gas for introduction of hydrogen atoms (H) and/or a gas for introduction of halogen atoms (X) may be introduced into a deposition chamber for sputtering, thereby forming a plasma atmosphere of a desired gas, and sputtering of the aforesaid target may be effected, while controlling the gas flow rates of the starting gas for supply of Ge according to a desired change rate curve.

In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere, otherwise following the same procedure as in the case of sputtering.

In the present invention, as the effective starting materials for the starting gases to be employed for formation of the second layer (II), the following compounds may be included.

First, the starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si. As the substances which can be starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred with respect to easy handling during layer formation and efficiency for supplying Ge.

Effective starting gases for introduction of halogen atoms to be used for formation of the seocnd layer (II) in the present invention may include a large number of halogen compounds, as exemplified preferably by halogen gases, halides, interhalogen compounds, or gaseous or gasifiable halogen compounds such as silane derivatives substituted with halogens. Further, there may also be included gaseous or gasifiable silicon compounds containing halogen atoms constituted of silicon atoms and halogen atoms as constituent elements as effective ones in the present invention.

Typical examples of halogen compounds preferably used for formation of the second layer (II) in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms (X), namely so-called silane derivatives substituted with halogen atoms, there may preferably be employed silicon halides such as $SiF_4$, $Si_2F_6$, $SiCl_4$, $SiBr_4$ and the like.

When the second layer (II) in the light-receiving member of the present invention is formed according to the glow discharge method by employment of such a silicon compound containing halogen atoms(X), it is possible to form the second layer (II) constituted of a-SiGe(H,X) on a substrate, having the first layer (I) formed on its surface, without use of a hydrogenated silicon gas as the starting gas capable of supplying Si together with the starting gas for Ge supply.

In the case of forming the second layer (II) containing halogen atoms (X) according to the glow discharge method, the basic procedure comprises introducing, for example, a silicon halide as the starting gas for Si supply, a hydrogenated germanium as the starting gas for Ge supply and a gas such as Ar, He, etc. at a predetermined mixing ratio into the deposition chamber for formation of the second layer (II) and exciting glow discharge to form a plasma atmosphere of these gases, whereby the second layer (II) can be formed on a substrate having the first layer (I) formed on its surface. In order to control the ratio of hydrogen atoms incorporated more easily, hydrogen gas or a gas of a silicon compound containing hydrogen atoms may also be mixed with these gases in a desired amount to form the second layer (II). Also, each gas is not restricted to a single species, but multiple species may be available at any desired ratio.

In either case of the sputtering method and the ion-plating method, introduction of halogen atoms(X) into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms during formation of the second layer (II), the halides or halo-containing silicon compounds as mentioned above can effectively be used. Otherwise, it is also possible to use effectively as the starting material for formation of the second layer (II) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $SiH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing hydrogen atoms can preferably be used as the starting material for introduction of halogen atoms, because hydrogen atoms, which are very effective for controlling electrical or photoconductive characteristics, can be introduced into the layer simultaneously with introduction of halogen atoms during formation of the second layer (II).

For introducing hydrogen atoms structurally into the second layer (II), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon of a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the second layer (II) constituting the light-receiving member to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the second layer (II), for example, the substrate temperature and/or the amount of the starting materials used for incorporation of hydrogen atoms (H) or halogen atoms (X) to be introduced into the deposition device system, discharging power, etc. may be controlled.

For incorporating a substance (C) for controlling conductivity such as the group III atoms or the group V atoms structurally into the second layer II a starting material for introduction of the group III atoms a starting material for introduction of the group V atoms as mentioned above may be introduced under gaseous state into a deposition chamber together with other starting materials for formation of the second layer (II) during layer formation, similarly as described about the formation of the first layer (I).

The second layer (II) in the light-receiving member of the present invention may have a thickness, which may be determined in view of the absorption coefficient of the second layer (II) relative to the photocarrier excitation light source, when the second layer (II) is used primarily for photocarrier generating layer, and it may preferably be made 1000Å to 50 μm, more preferably 1000Å to 30 μm, most preferably 1000Å to 20 μm.

On the other hand, when the second layer (II) is used primarily as the layer for generation and transportation of photocarriers, the thickness may be determined suitably as desired so that the photocarriers may be transported with good efficiency, and may preferably be made 1 to 100 μm, more preferably 1 to 80 μm, most preferably 2 to 50 μm.

The third layer (III) 105 to be formed on the second layer (II) 104 in the light-receiving member of the present invention has a free surface and is provided primarily for the purpose of accomplishing the objects of the present invention with respect to humidity resistance, continuous repeated use characteristics, dielectric strength, environmental use characteristics and durability. Since each of the second layer (II) and the third layer (III) comprises an amorphous material having common constituent atoms of silicon atoms, chemical stability is sufficiently ensured at the laminated interface thereof.

The third layer (III) in the present invention is constituted of an amorphous material containing silicon atoms (Si) and nitrogen atoms(N), optionally together with hydrogen atoms (H) and/or halogen atoms (X) (hereinafter written as "a-$(Si_xN_{1-x})_y(H,X)_{1-y}$, wherein $0<x, y<1$).

Formation of the third layer (III) constituted of a-$(Si_xN_{1-x})_y(H,X)_{1-y}$ may be performed according to the glow discharge method, the sputtering method, the ion implantation method, the ion plating method, the electron beam method, etc. These preparation methods may be suitably adopted depending on various factors such as the preparation conditions, the degree of the load for capital investment for installations, the production scale, the desirable characteristics required for the light-receiving member to be prepared, etc. For the advantages of relatively easy control of the preparation conditions for preparing light-receiving members having desired characteristics and easy introduction of silicon atoms together with nitrogen atoms and halogen atoms, into the third layer (III) to be prepared, there may preferably be employed the glow discharge method or the sputtering methods. Further, the third layer (III) may be formed by using the glow discharge method and the sputtering method in combination in the same device system.

For formation of the third layer (III) according to the glow discharge method, starting gases for formation of a-$(Si_xN_{1-x})_y(H,X)_{1-y}$, optionally mixed at a predetermined mixing ratio with diluting gas, may be introduced into a deposition chamber for vacuum deposition in which a substrate having the second layer (II) formed thereon is placed, and the gas introduced is made into a gas plasma by excitation of glow discharging, thereby depositing a-$(Si_xN_{1-x})_y(H,X)_{1-y}$ on the seocnd layer (II) which has already been formed on the aforesaid substrate.

As the starting gases for formation of a-$(Si_xN_{1-x})_y(H,X)_{1-y}$ to be used in the present invention, it is possible to use most of gaseous substances or gasified gasifiable substances containing at least one of silicon atom (Si), nitrogen atom(N), hydrogen atom(H) and halogen atom (X) as constituent atoms.

In case when a starting gas having Si as constituent atoms as one of Si, N, H and X is employed, there may be employed, for example, a mixture of a starting gas containing Si as constituent atom, a starting gas containing N as constituent atom and a starting gas contining H and/or X as constituent atom at a desired mixing ratio, or alternatively a mixture of a starting gas containing Si as constituent atoms, a starting gas containing N and H and/or N and X also at a desired mixing ratio, or a mixture of a starting gas containing Si as constituent atoms and a gas containing three atoms of Si, N and H or of Si, N and X as constituent atoms at a desired mixing ratio.

Alternatively, it is also possible to use a mixture of a starting gas containing Si and H as constituent atoms and a starting gas containing N as constituent atom or a mixture of a starting gas containing Si and X as constituent atoms and a starting gas containing N as constituent atom.

In the present invention, preferable halogen atoms (X) to be contained in the third amorphous layer (III) are F, Cl, Br and I. Particularly, F and Cl are preferred.

The starting materials used for forming the third layer (III) to be used in the present invention may include gaseous or gasifiable hydrogenated silicons (silanes) containing Si and H such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

When these starting materials are used, H can be introduced together with Si in the layer formed by suitable choice of the layer forming conditions.

As the starting materials effectively used for supplying Si, in addition to hydrogenated silicon as mentioned above, there may be included silicon compounds containing halogen atoms (X), namely the so called silane derivatives substituted with halogen atoms, including halogenated silicon such as $SiF_4$, $Si_2F_6$, $SiCl_4$, $SiBr_4$, etc., as preferable ones. Further, halides containing hydrogen atom as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_2Br_2$, $SiHBr_3$, etc. may also be mentioned as the effective starting materials for supplying Si for formation of the third layer (III).

Also, in the case of employing a silicon compound containing halogen atoms (X), X can be introduced together with Si in the layer formed by suitable choice of the layer forming conditions as mentioned above.

Effective starting materials to be used as the starting gases for introduction of halogen atoms (X) in formation of the third layer (III) in the present invention, there may be included, in addition to those as mentioned above, for example, halogen gases such as fluorine, chlorine, bromine and iodine; interhalogen compounds such as ClF, $ClF_3$, BrF, $BrF_3$, $BrF_5$, $IF_3$, $IF_7$, ICl, IBr, etc.; and hydrogen halogenide such as HF, HCl, HBr, HI etc.

In the present invention the starting materials which can be effectively used as the starting gas for introduction of nitrogen atoms (N) to be used in formation of the third layer (III) may include, for example, gaseous or gasifiable nitrogen compounds, nitrides and azides containing N or N and H as constituent atoms, for example, nitrogen ($N_2$), ammonia ($NH_3$), hydrazine ($H_2NNH_2$), hydrogen azide ($HN_3$), ammonium ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), nitrogen tetrafluoride ($F_4N_2$) and the like.

These substances for forming the third layer (III) may be chosen as desired and used during formation of the third layer (III) so that silicon atoms, nitrogen atoms and, if desired, halogen atoms and/or hydrogen atoms may be contained in the third layer (III) formed at a predetermined composition ratio.

Formation of the third layer (III) according to the sputtering method may be practiced as follows.

In the first place, when a target constituted of Si is subjected to sputtering in an atomsphere of an inert gas such as Ar, He, etc. or a gas mixture based on these gases, a starting gas for introduction of nitrogen atoms (N) may be introduced, optionally together with starting gases for introduction of hydrogen atoms (H) and/or halogen atoms(X), into a deposition chamber for carrying out sputtering.

In the second place, nitrogen atoms (N) can be introduced into the third layer (III) formed by the use of a target constituted of Si, or two sheets of a target constituted of Si and a target constituted of $Si_3N_4$, or a target constituted of Si and $Si_3N_4$. In this case if the starting gas for introduction of nitrogen atoms (N) as mentioned above is used in combination, the amount of nitrogen atoms (N) to be incorporated in the third layer (III) can easily be controlled as desired by controlling the flow rate thereof.

As the starting gases for introduction of N, H and X, there may be employed those for formation of the third layer (III) as mentioned in the glow discharge as described above as effective gases also in case of sputtering.

In the present invention, as the diluting gas to be used in forming the third layer (III) by the glow discharge method or the sputtering method, there may be preferably employed so called rare gases such as He, Ne, Ar and the like.

The third layer (III) in the present invention should be carefully formed so that the required characteristics may be given exactly as desired.

That is, a substance containing as constituent atoms Si, N, and if necessary, H and/or X can take various forms from crystalline to amorphous, electrical properties from conductive through semi-conductive to insulating and photoconductive properties from photoconductive to non-photoconductive depending on the preparation conditions. Therefore, in the present invention, the preparation conditions are strictly selected as desired so that there may be formed a-$(Si_xN_{1-x})_y(H,X)_{1-y}$ having desired characteristics depending on the purpose. For example, when the third layer (III) is to be provided primarily for the purpose of improvement of dielectric strength, a-$(Si_xN_{1-x})_y(H,X)_{1-y}$ is prepared as an amorphous material having marked electric insulating behaviours under the usage conditions.

Alternatively, when the primary purpose for provision of the third layer (III) is improvement of continuous repeated use characteristics or enviromental characterisctics during usage the degree of the above electric insulating property may be alleviated to some extent and a-$(Si_xN_{1-x})_y(H,X)_{1-y}$ may be prepared as an amorphous material having sensitivity to some extent to the liqht irradiated.

In forming the third layer (III) comprising a-$(Si_xN_{1-x})_y(H,X)_{1-y}$ on the surface of the second layer (II), the substrate temperature during layer formation is an important factor having influences on the structure and the characteristics of the layer to be formed, and it is desired in the present invention to control severely the substrate temperature during layer formation so that a-$(Si_xN_{1-x})_y(H,X)_{1-y}$ having intended characteristics may be prepared as desired.

As the substrate temperature in forming the third layer (III) for accomplishing effective the objects in the present invention, there may be selected suitably the optimum temperature range in conformity with the method for forming the third layer (III) in carrying out formation of the third layer (III), preferably be 20° to 400 ° C., more preferably 50° to 350° C. , most preferably 100° to 300° C.

For formation of the third layer (III), the glow discharge method or the sputtering method may be advantageously adopted, because severe control of the composition ratio of atoms constituting the layer or control of layer thickness can be conducted with relative ease as compared with other methods. In case when the third layer (III) is to be formed according to these layer forming methods, the discharging power, the gas pressure during layer formation is one of important factors influencing the characteristics of a-$(Si_xN_{1-x})_y(H,X)_{1-y}$ to be prepared, similarly as the aforesaid substrate temperature.

The discharging power condition for preparing effectively a-$(Si_xN_{1-x})_y(H,X)_{1-y}$ having characteristics 5 for accomplishing the objects of the present invention with good productivity may preferably be 10 to 300 W, more preferably 20 to 250 W, most preferably 50 to 200 W.

The gas pressura in a deposition chamber may preferably be 0.01 to 1 Torr, more preferably 0.1 to 0.5 Torr.

In the present invention, the above numerical ranges may be mentioned as preferable numerical ranges for the support temperature, discharging power, etc. for preparation of the third layer (III). However, these factors for layer formation should not be determined separately independently of each other, but it is desirable that the optimum values of respective layer forming factors should be determined based on mutual organic relationships so that a third layer (III) comprising a-$(Si_xN_{1-x})_y(H,X)_{1-y}$ having desired characteristics may be formed.

The content of nitrogen atoms in the third layer (III) in the light-receiving member of the present invention is one of important factors for obtaining the desired characteristics to accomplish the objects of the present invention, similarly as the conditions for preparation of the second amorphous layer (II). The content of nitrogen atoms, in the third layer (III) in the present invention is determined as desired depending on the characteristics of the amorphous material constituting the third layer (III).

More specifically, the amorphous material represented by the above formula a-$(Si_xN_{1-x})_y(H,X)_{1-y}$ may be broadly classified into an amorphous material constituted of silicon atoms and nitrogen atoms (herein after written as "a-$Si_aN_{1-a}$", where $0<a<1$), an amorphous material constituted of silicon atoms, nitrogen atoms and hydrogen atoms (hereinafter written as a-$(Si_bN_{1-b})_cH_{1-c}$, where $0<b$, $c<1$) and an amorphous material constituted of silicon atoms, nitrogen atoms, halogen atoms and optinally hydrogen atoms (hereinafter written as "a-$(Si_dN_{1-d})_e$ $(H,X)_{1-e}$", where $0<d$, $e<1$).

In the present invention, when the third layer (III) is to be constituted of a-$Si_aN_{1-a}$, the content of nitrogen atoms (C) in the third layer (III) may preferably be $1\times10^{-3}$ to 60 atomic %, more preferably 1 to 50 atomic %, most preferably 10 to 45 atomic %, namely in terms of representation by a, a being preferably 0.4 to 0.99999, more preferably 0.5 to 0.99, most preferably 0.55 to 0.9.

In the present invention, when the third layer (III) is to be constituted of a-$(Si_bN_{1-b})_cH_{1-c}$, the content of nitrogen atoms (C) may preferably be $1\times10^{-3}$ to 60 atomic %, more preferably 1 to 50 atomic %, most preferably 10 to 50 atomic %, the content of hydrogen atoms preferably 30 to 40 atomic %, more preferably 2 to 35 atomic %, most preferably 5 to 30 atomic %, and the photoconductive member formed when the hydrogen content is within these ranges can be sufficiently applicable as excellent one in practical aspect.

That is, in terms of the representation by the above a-$(Si_bN_{1-b})_cH_{1-c}$, b should preferably be 0.45 to 0.99999, more preferably 0.45 to 0.99, most preferably 0.45 to 0.9, and, c preferably 0.6 to 0.99, more preferably 0.65 to 0.98, most preferably 0.7 to 0.95.

When the third layer (III) is to be constituted of a-$(Si_dN_{1-d})_e(H,X)_{1-e}$, *the content of nitrogen atoms may preferably be* $1\times10^{-3}$ to 60 atomic %, more preferably 1 to 60 atomic %, most preferably 10 to 55 atomic %, the content of halogen atoms preferably 1 to 20 atomic %, more preferably 1 to 18 atomic %, most preferably 2 to 15 atomic %. When the content of halogen atoms is within these ranges, the photoconductive member prepared is sufficiently applicable in practical aspect. The content of hydrogen atoms optionally contained may preferably be 19 atomic % of less, more preferably 13 atomic % or less.

That is in terms of representatioin by d and e in the above a-$(Si_dN_{1-d})_e(H,X)_{1-e}$, *d should preferably be* 0.4 to 0.99999, more preferably 0.4 to 0.99, most preferably 0.45 to 0.9, and e preferably 0.8 to 0.99, more preferably 0.82 to 0.99, most preferably 0.85 to 0.98.

The range of the numerical value of layer thickness of the third layer (III) is one of important factors to accomplish effectively the objects of the present invention. It should desirably be determined depending on the intended purpose so as to effectively accomplish the objects of the present invention.

The layer thickness of the third layer (III) is also required to be determined as desired suitably with due considerations about the relationships with the contents of carbon atoms, the relationship with the layer thicknesses of the first layer (I) and the second layer (II), as well as other organic relationships with the characteristics required for respective layer regions.

In addition, it is also desirable to have considerations from economical point of view such as productivity of capability of bulk production.

The third layer (III) in the present invention is desired to have a layer thickness preferably of 0.003 to 30μ, more preferably 0.003 to 30μ, most preferably 0.003 to 30μ.

In the light-receiving member of the present invention, for the purpose of effecting higher sensitization and higher dark resistance, or further improving adhesion between the substrate and the light-receiving layer or between each layer constituting the light-receiving layer, at least one of the first layer (I) and the second layer (II) should desirably contain at least one of oxygen atoms and carbon atoms.

The oxygen atoms and/or carbon atoms contained in at least one of the first layer (I) and the second layer (II) may be contained either evenly throughout the whole region or only in a part of the region.

The distribution C(OC) of oxygen atoms and carbon atoms may be either uniform or ununiform in the layer thickness direction of the light-receiving layer.

In the present invention, the layer region (OC) containing oxygen atoms and/or carbon atoms provided in at least one of the first layer (I) and the second layer (II) is provided so as to occupy the whole layer region of these layers when it is intended to improve photosensitivity and dark resistance.

Further, when it is intended to strengthen the adhesion at the contacted interface between the substrate and the first layer (I) and that at a contacted interface between the layers constituting the light-receiving layer, the above-mentioned layer region (OC) is provided so as to occupy the interface between the layers whose adhesion is to be strengthened and a portion in the vicinity of said interface. For example, when it is intended to strengthen the adhesion between the substrate and the first layer (I), the layer region (OC) is provided so as to occupy the end portion layer region of the first layer (I) on the substrate side; when it is intended to strengthen the adhesion between the first layer (I) and the second layer (II), the layer region (OC) is provided so as to occupy the interface between the first layer (I) and the second layer (II) and a portion in the vicinity of said interface; and when it is intended to strengthen the adhesion between the second layer (II) and the third layer (II), the layer region (OC) is provided so as to occupy the end portion layer region of the second layer (II) on the third layer (III) side.

For more effectively accomplishing these objects, it is desirable that oxygen atoms and/or carbon atoms are contained in both of the first layer (I) and the second layer (II).

In the former case, the content of oxygen atoms and carbon atoms to be contained in the layer region (OC) is made relatively smaller in order to maintain high photosensitivity, while in the latter case, it should desirably be made relatively larger in order to ensure strengthening of adhesion between the layers.

For the purpose of accomplishing simultaneously both of the former and the latter cases, oxygen atoms and carbon atoms may be distributed at relatively higher content on the substrate side and at relatively lower content in the layer region on the free surface side of the light receiving layer, or alternatively, there may be formed a distribution of oxygen atoms such that oxygen atoms are not positively contained in the surface layer region on the free surface side of the light receiving layer.

Further, when it is intended to increase apparent dark resistance by preventing injection of charges from the first layer (I), oxygen atoms and/or carbon atoms may be distributed on the substrate side of the first layer (I), or oxygen atoms may be distributed at higher content at the interface between the first layer (I) and the second layer (II) and/or in the vicinity of the interface.

In the present invention, the number of the above-mentioned layer region to be formed is not limited to only one and a plural of the layer regions (OC) may be provided in the light-receiving layer depending on the objects as described above.

In the present invention, the content of oxygen atoms and carbon atoms to be contained in the layer region (OC) provided in at least one of the first layer (I) and the second layer (II) may be suitably selected depending on the characteristics required for the layer region (OC) per se or, when said layer region (OC) is provided in the direct contact with the substrate, depending on the organic relationship such the relation with the characteristics at the contacted interface with said substrate and others.

When another layer region is to be provided in direct contact with said layer region (OC), the content of oxygen atoms and carbon atoms may be suitably selected also with considerations about the characteristics of said another layer region and the relation with the characteristics of the contacted interface with said another layer region.

The content of oxygen atoms or the content of carbon atoms or the sum of the content of oxygen atoms and carbon atoms in the layer region (OC), which may suitably be determined as desired depending on the characteristics required for the light-receiving member to be formed, may be preferably 0.001 to 50 atomic %, more preferably 0.002 to 40 atomic %, most preferably 0.003 to 30 atomic %.

In the present invention, when the layer region (OC) containing oxygen atoms and/or carbon atoms is provided in a desired portion of the layer region constituting the first layer (I), the starting material for introduction of oxygen atoms and/or the starting material for introduction of carbon atoms may be used in combination with the above-mentioned starting materials for forming the first layer (I) during the formation of the first layer (I) while controlling the amount thereof, thereby having these atoms contained in the layer to be formed.

The oxygen atoms and/or carbon atoms contained in the first layer (I) may be contained either evenly throughout the whole region or only in a part of the region.

The distribution C (OC) of oxygen atoms and carbon atoms may be either uniform or ununiform in the layer thickness direction of the first layer (I).

In the present invention, the layer region (OCI) containing oxygen atoms and/or carbon atoms provided on the first layer (I) is provided so as to occupy the whole layer region of the first layer (I) when it is intended to improve photosensitivity and dark resistance, while it is provided so as to occupy the end portion layer region of the substrate side and/or the second layer (II) side when it is intended to strengthen adhesion with the substrate or the second layer (II).

The content of oxygen atoms and carbon atoms to be contained in the layer region (OCI) provided in such a first layer (I) can be selected suitably depending on the organic relationships with the characteristics required for the layer region (OCI) itself so as to accomplish the objects as mentioned above, the characteristics required at the contacted interface with the substrate, the characteristics of other layer region which is in direct contact with the layer region (OCI), the characteristics required at the contacted interface with other layer regions and the like.

The content of oxygen atoms or the content of carbon atoms or the sum of the contents of oxygen atoms and carbon atoms in the layer region (OCI), which may be determined suitably as desired depending on the characteristics of the light-receiving member to be formed, may be preferably 0.001 to 50 atomic %, more preferably 0.002 to 40 atomic %, most preferably 0.003 to 30 atomic %.

When the glow discharge method is applied for formation of the layer region (OCI), the starting materials for introduction of oxygen atoms and/or the starting materials for introduction of carbon atoms are further added to those selected as desired from among the starting materials for formation of the first layer (I) mentioned above. As such starting materials for introduction of oxygen atoms and starting materials for introduction of carbon atoms, most of gaseous or gasified gasifiable substances having at least oxygen atoms or carbon atoms as constituent atoms may be employed.

As combination of a starting gases to be used, there may be mentioned the following combinations: (a) A mixture of a starting gas containing silicon atoms (Si) as constituent atom, a starting gas containing oxygen atoms (O) as constituent atom, or a starting gas containing carbon atoms (C) as constituent atoms and optionally a starting gas containing hydrogen atoms (H) as constituent atom and/or a starting gas containing halogen atoms (X) as constituent atom at a desired mixing ratio, (b) A mixture of a starting gas containing silicon atoms (Si) and hydrogen atoms (H) as constituent atoms, a starting gas containing halogen atoms (X) as constituent atom and a starting gas containing oxygen atoms (O) or halogen atoms (X) as constituent atom also at a desired ratio, (C) A mixture of a starting gas containing silicon atoms (Si) as constituent atom, a starting gas containing oxygen atoms (O) or carbon atoms (C) as constituent atom and a starting gas containing hydrogen atoms (H) constituent atoms, (d) A mixture of a starting gas containing silicon atoms (Si) constituent atoms and a starting gas containing three constituent atoms of silicon atoms (Si), oxygen atoms (O) or carbon atoms (C), and hydrogen atoms (H).

As the starting materials effectively used for supplying oxygen atoms (O) for formation of the layer region (OCI), there may be employed a starting gas containing oxygen atoms (O) as constituent atoms or a starting gas containing oxygen atoms (O) and hydrogen atoms (H) as constituent atoms, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide, and lower siloxanes containing silicon atoms (Si), oxygen atoms (O) and hydrogen atoms (H) as constituent atoms such as disiloxane $H_3SiOSiH_3$, trisiloxane $H_3SiOSiH_2OSiH_3$, and the like.

The starting materials which can effectively be used as the starting gas for supplying carbon atoms (C) to be used in formation of the layer region (OCI) may include a starting gas containing carbon atoms (C) as constituent atom or a starting gas containing C and H as constituent atoms such as saturated hydrocarbons having 1 to 5 carbon atoms, ethylenic hydrocarbons having 2 to 5 carbon atoms, acetylenic hydrocarbons having 2 to 4 carbon atoms and the like.

More specifically, there may be included, as saturated hydrocarbons, methane, ethane, propane, n-butane, pentane; as ethylenic hydrocarbons, ethylene, propylene, butene-1, butene-2, isobutylene, pentene; as acetylenic hydrocarbons, acetylene, methyl acetylene, butyne ($C_4H_6$), etc.

Otherwise, there may be mentioned a starting gas containing silicon atom (Si), carbon atom (C) and hydrogen atom (H) as constituent atoms such as $Si(CH_3)_4$, $Si(C_2H_5)_4$ and the like.

For formation of the first layer (I) containing oxygen atoms accoridng to the sputtering method, a single crystalline or polycrystalline Si wafer, $SiO_2$ wafer or a wafer containing Si and $SiO_2$ mixed therein may be employed and sputtering of these wafers may be conducted in various gas atmospheres.

For example, when Si wafer is employed as the target, a starting gas for introduction of oxygen atoms optionally together with a starting gas for introduction of hydrogen atoms and/or halogen atoms, which may optionally be diluted with a diluting gas, may be introduced into a deposition chamber for sputtering to form gas plasma of these gases, in which sputtering of the aforesaid Si wafer may be effected.

Alternatively, by use of separate targets of Si and $SiO_2$ or one sheet of a target containing Si and $SiO_2$ mixed therein, sputtering may be effected in an atmosphere of a diluting gas as a gas for sputtering or a gas atmosphere containing at least hydrogen atoms (H) and/or halogen atoms (x) as constituent atoms to form the first layer (I) a desired layer region (OI) of which contains oxygen atoms. As the starting gas for introduction of oxygen atoms, there may be employed the starting gases for introduction of oxygen atoms shown as examples in the glow discharge method previously described also as effective gases in case of sputtering.

For formation of the first layer (I) containing carbon atoms according to the sputtering method, a single crystalline or polycrystalline Si wafer and/or C wafer or a wafer containing Si and C mixed therein may be employed and sputtering of these wafers may be conducted in various gas atmospheres.

For example, when Si wafer is employed as the target, a starting gas for introduction of carbon atoms optionally together with a starting gas for introduction of hydrogen atoms and/or halogen atoms, which may optionally be diluted with a diluting gas, may be introduced into a deposition chamber for sputtering to form gas plasma of these gases, in which sputtering of the aforesaid Si wafer may be effected.

Alternatively, by use of separate targets of Si and C or one sheet of a target containing Si and C mixed therein, sputtering may be effected in an atmosphere of a diluting gas as a gas for sputtering or a gas atmosphere containing at least hydrogen atoms (H) and/or halogen atoms (X) as constituent atoms to form the first layer (I) a desired layer region (CI) of which contains carbon atoms. As the starting gas for introduction of carbon atoms, there may be employed the starting gases for introduction of carbon atoms shown as examples in the glow discharge method previously described also as effective gases in case of sputtering.

In the light-receiving member of the present invention, for the purpose of effecting higher sensitization and higher dark resistance, or further improving adhesion between the first layer (I) and the second layer (II) or between the second layer (II) and the third layer (III), or adhesion of the first layer (I), the second layer (II) and the third layer (III), the second layer (II) should desirably contain oxygen atoms and/or carbon atoms.

The oxygen atoms and/or atoms contained in the second layer (II) may be contained either evenly throughout the whole region or only in a part of the region.

The distribution C (OC) of oxygen atoms and/or carbon atoms may be either uniform or ununiform in the layer thickness direction of the second layer (II).

In the present invention, the layer region (OCII) containing oxygen atoms and/or carbon atoms provided on the second layer (II) is provided so as to occupy the whole layer region of the second layer (II) when it is intended to improve photosensitivity and dark resistance, while it is provided so as to occupy the end portion layer region of the first layer (I) and/or the third layer (III) when it is intended to strengthen adhesion with the first layer (I) and/or the third layer (III).

The content of oxygen atoms and/or carbon atoms to be contained in the layer region (OCII) provided in such a second layer (II) can be selected suitably depending on the characteristics required for the layer region (OCII) itself so as to accomplish the objects as mentioned above, the characteristics required at the contacted interface with the first layer (I) or the third layer (III) or the organic relationships with the characteristics of the first layer (I) or the third layer (III).

The content of oxygen atoms or carbon atoms and the sum of the contents of oxygen atom and carbon atom in the layer region (OCII), which may be determined suitably as desired depending on the characteristics of the light-receiving member to be formed, may be preferably 0.001 to 50 atomic %, more preferably 0.002 to 40 atomic %, most preferably 0.003 to 30 atomic %.

The second layer (II) in the light-receiving member of the present invention may have a thickness, which may be determined in view of the absorption coeffecient of the second layer (II) relative to the photocarrier excitation light source, when the second layer (II) is used primarily for photocarrier generating layer, and it may preferably be made 1000 Å to 50 μm, more preferably 1000 Å to 30 μm, most preferably 1000 Å to 20 μm.

On the other hand, when the second layer (II) is used primarily as the layer for generation and transportation of photocarriers, the thickness may be determined suitably as desired so that the photocarriers may be transported with good efficiency, and may preferably be made 1 to 100 μm, more preferably 1 to 80 μm, most preferably 2 to 5 μm.

In the present invention, when a layer region (ON) containing oxygen atoms and/or carbon atoms is provided in the second layer (II), a starting material for introduction of oxygen atoms and/or carbon atoms may be used in combination while controlling its amount during formation of the second layer (II) by use of the above starting materials thereby incorporating oxygen atoms and/or nitrogen atoms in the layer formed.

When the glow discharge method is applied for formation of the layer region (OCII), the starting materials for introduction of oxygen atoms and/or carbon atoms are further added to those selected as desired from among the starting materials for formation of the second layer (II). As such starting materials for introduction of oxygen atoms and/or carbon atoms, most of gaseous or gasified gasifiable substances having oxygen atoms and/or carbon atoms as constituent atoms may be employed.

As such starting materials for introduction of oxygen atoms and starting materials for intorduction of carbon atoms, there may be mentioned all the starting materials enumerated above in connection with the introduction of oxygen atoms and/or carbon atoms into the first layer (I).

In the case where the second layer (II) is formed according to the sputtering method, the introduction of oxygen atoms and/or carbon atoms into the second layer (II) may be effected by the same procedure as that described in connection with the introduction of oxygen atoms and/or carbon atoms into the first layer (I).

In the present invention, nitrogen atoms may be contained into the layer region (OC) in addition to oxygen atoms and/or carbon atoms to further increase the effect obtained by using oxygen atoms and/or carbon atoms.

The starting materials which can effectively be used as the starting gas for introduction of nitrogen atoms (N) into the layer region (OC) may include, for example, gaseous or gasifiable nitrogen compounds, nitrides and azides containing N or N and H as constituent atoms, for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), nitrogen tetrafluoride ($F_4N_2$) and the like.

In the case where the sputtering method is used for the introduction of nitrogen atoms (N) into the layer region (OC), there may be mentioned $Si_3N_4$, a mixture of $Si_3N_4$ and graphite and/or $SiO_2$ as a target used for introduction of nitrogen atoms (N).

In the present invention, when providing a layer region (OC) containing oxygen atoms and/or carbon atoms during formation of the first layer (I) and the second layer (II) in at least one of these layers, formation of the layer region (OC) having a desired depth profile in the direction of layer thickness formed by varying the distribution concentration C(OC) of oxygen atoms and/or carbon atoms contained in said layer region (OC) may be conducted in case of glow discharge by introducing a starting gas for introduction of oxygen atoms and/or carbon atoms of which the distribution concentration C(OC) is to be varied into a deposition chamber, while varying suitably its gas flow rate according to a desired change rate curve.

In case when sputtering is employed, for example, when a target containing Si, $SiO_2$ and/or graphite mixed therein is used as the target for sputtering, the mixing ratio of Si to $SiO_2$ and/or graphite may be previously varied in the layer thickness direction of the target, whereby a desired depth profile of oxygen atoms and/or carbon atoms in the layer thickness direction can be obtained.

The substrate 101 to be used in the present invention may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrate, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrate should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 100 in FIG. 1 is to be used as an image forming member for electrophotography, it may desirably be formed into an endless belt or a cylinder for use in continuous high speed copying. The substrate may have a thickness, which is conveniently determined so that a light-receiving member as desired may be formed. When the light-receiving member is required to have a flexibility, the substrate is made as thin as possible, so far as the function of a substrate can be exhibited. However, in such a case, the thickness is preferably 10 $\mu$m or more form the points of fabrication and hadling of the substrate as well as its mechanical strength.

As it will clearly be seen from the member of the present invention can solve all of the various problems as mentioned above and exhibit very excellent electrical, optical, photoconductive characteristics, dielectric strength and use environment characteristics.

In particular, the light-receiving member of the present invention is free from any influence from residual potential on image formation when applied for an image forming member for electrophotography, with its electrical characteristics being stable with high sensitivity, having a high SN ratio as well as excellent light fatigue resistance and excellent repeated use characteristic and being capable of providing images of high quality of high density, clear halftone and high resolution repeatedly and stably.

Further, the light-receiving mexber of the present invention is high in photosensitivity over all the visible light region, particularly excellent in matching to semiconductor laser, and rapid in response to light.

Next, an example of the process for producing the light-receiving member of this invention is to be briefly described.

Figure 22:
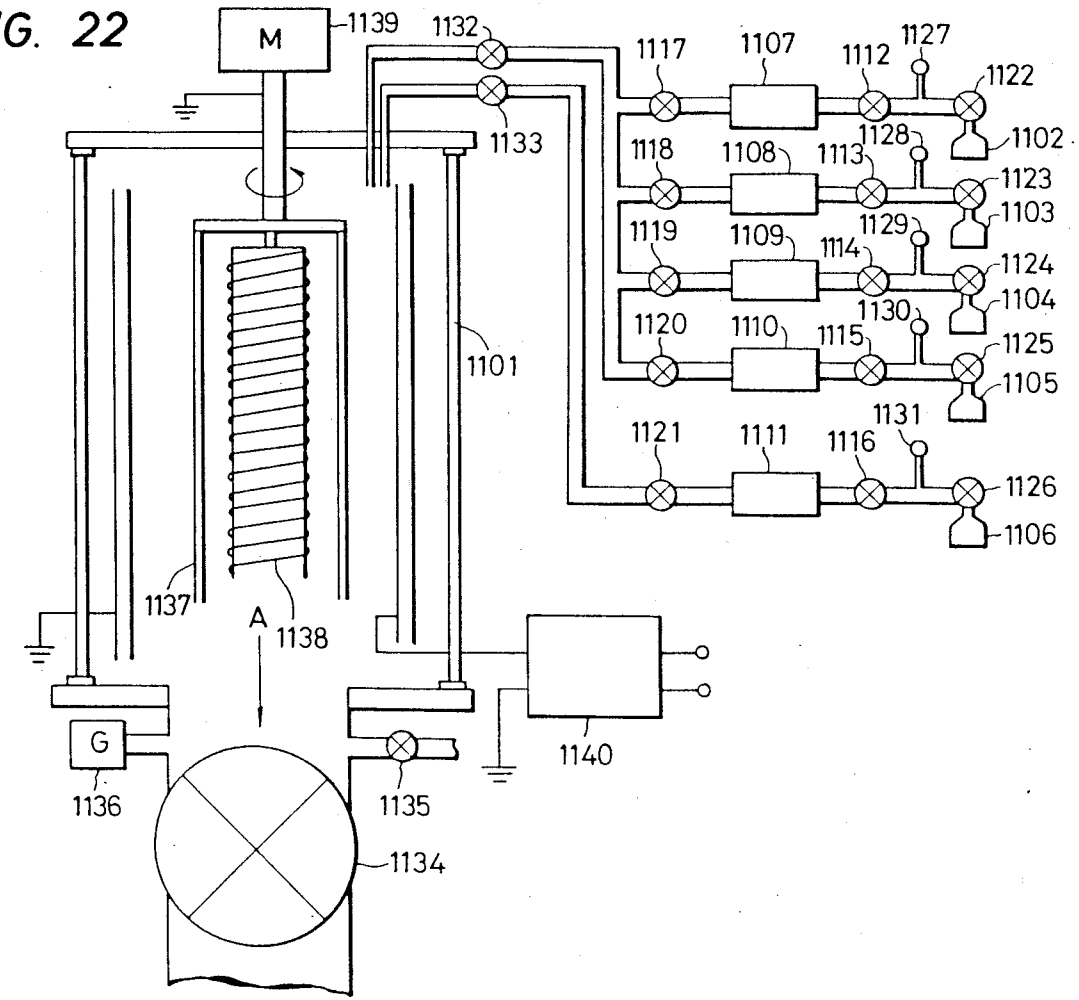
FIG. 22 is a drawing showing the preparation device of the light-receiving member according to the glow discharge decomposition method.

FIG. 22 shows one example of a device for producing a light-receiving member according to the glow discharge decomposition method.

In the gas bombs 1102–1106 there are hermetically contained starting gases for formation of the light-receiving member of the present invention. For example, 1102 is a bomb containing $SiH_4$ gas diluted with He (purity: 99.999%, hereinafter abbreviated as "$SiH_4$/He"), 1103 is a bomb containing $GeH_4$ gas diluted with He (purity: 99.999%, hereinafter abbreviated as "$GeH_4$/He"), 1104 is a bomb containing $SiF_4$ gas diluted with He (purity: 99.999%, hereinafter abbreviated as $SiF_4$/He gas), 1105 is a bomb containing $B_2H_6$ gas diluted with He (purity: 99.999%, hereinafter abbreviated as $B_2H_6$/He) and 1106 is a bomb containing $NH_3$ gas diluted with He (purity: 99.99%, hereinafter abbreviated as $NH_3$/He).

Although not shown in the Figure, it is also possible to provide additional bombs other than these bombs, if necessary.

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes $5\times10^{-6}$ Torr, the auxiliary valves 1132, 1133 and the outflow valves 1117–1121 are closed.

Referring now to an example of forming a first layer (I) on the cylindrical substrate 1137, $SiH_4$/He gas from the gas bomb 1102, $B_2H_6$/He gas from the gas bomb 1105 are permitted to flow into the mass-flow controllers 1107, 1110 respectively, by opening the valves 1122, 1125 and controlling the pressures at the outlet pressure gauges 1127, 1130 to 1 Kg/cm$^2$ and opening gradually the inflow valves 1112, 1115, respectively. Subsequently, the outflow valves 1117, 1120 and the auxiliary valve 1132 are gradually opened to permit respective gases to flow into the reaction chamber 1101. The outflow valves 1117, 1120 are controlled so that the flow rate ratio of $SiH_4$/He to $B_2H_6$/He may have a desired value and opening of the main valve 1134 is also controlled while watching the reading on the vacuum indicator 1136 so that the pressure in the reaction chamber may reach a desired value. And, after confirming that the temperature of the substrate 1137 is set at 50°–400° C. by the heater 1138, the power source 1140 is set at a desired power to excite glow discharge in the reaction chamber 1101, thereby forming a first layer (I) on the substrate cylinder 1137.

During layer formation, for the purpose of uniformizing layer formation, the substrate cylinder 1137 is rotated at a constant speed by the motor 1139. Finally, all the valves of the gas operational system are closed, and the reaction chamber 1101 is evacuated once to high vacuum.

Referring next to an example of forming a second layer (II) on the thus formed first layer (I), when the reading on the vacuum indicator 1136 becomes $5\times10^{-6}$ Torr, the operation similar to that as described above is repeated. That is, $SiH_4$/He gas from the gas bomb 1102, $GeH_4$/He gas from the gas bomb 1103 and $B_2H_6$/He gas from the gas bomb 1105 are permitted to flow into the mass flow controllers 1107, 1108 and 1110, respectively, by opening the valves 1122, 1123 and 1125, respectively to adjust the outlet pressure gauges to the pressure of 1 Kg/cm$^2$, thereby opening gradually the in-flow valves 1112, 1113 and 1115. Subsequently, the out-flow valves 1117, 1118 and 1120, and the auxiliary valve 1132 are gradually opened to permit the respective gases into the reaction chamber 1101. The out-flow valves 1117, 1118 and 1120 are thereby controlled so that the ratios of $SiH_4$/He gas flow rate, $GeH_4$/He gas flow rate and $B_2H_6$/He gas flow rate may have desired values to control the concentration distribution of germanium atoms in the layer thickness direction in the second layer (II) to a desired distribution. Also, the opening of the main valve 1134 is controlled while watching the vacuum indicator 1136 so that the pressure in the reaction chamber may become a desired value. And, after confirming that the temperature of the substrate cylinder 1137 is set at a predetermined temperature of 50° to 400° C. by the heater 1138, the power source 1140 is set at a desired power, followed by excitation of glow discharge, thereby forming a second layer (II) on the substrate cylinder 1137 similarly as in the case of formation of the first layer (I).

Next, when forming a third layer (III) on the thus formed second layer (II), similarly as described previously, all the valves of the gas operational system used are closed, and the reaction chamber 1101 is evacuated once to high vacuum. When the reading on the vacuum indicator 1136 becomes $5\times10^{-6}$ Torr, similarly as described above, for example, by supplying $SiH_4$/He gas from the gas bomb 1102, $SiF_4$/He gas from the gas bomb 1104 and $NH_3$/He gas from the gas bomb 1106, glow discharge may be excited to form the third layer (III). The content of nitrogen atoms in the third layer (III) can be controlled by controlling the flow rate of $NH_3$/He gas fed.

The present invention is described by referring to the following Examples.

EXAMPLE 1

By means of the preparation device as shown in FIG. 22, respective samples of image forming members for electrophotography (96 Samples of No. 1-1A to 16-6A as the total) were prepared, respectively, by forming light-receiving layers on cylinders composed of aluminum according to the glow discharge method as described previously in detail under the conditions as shown in Table 1A.

Figure 14A:
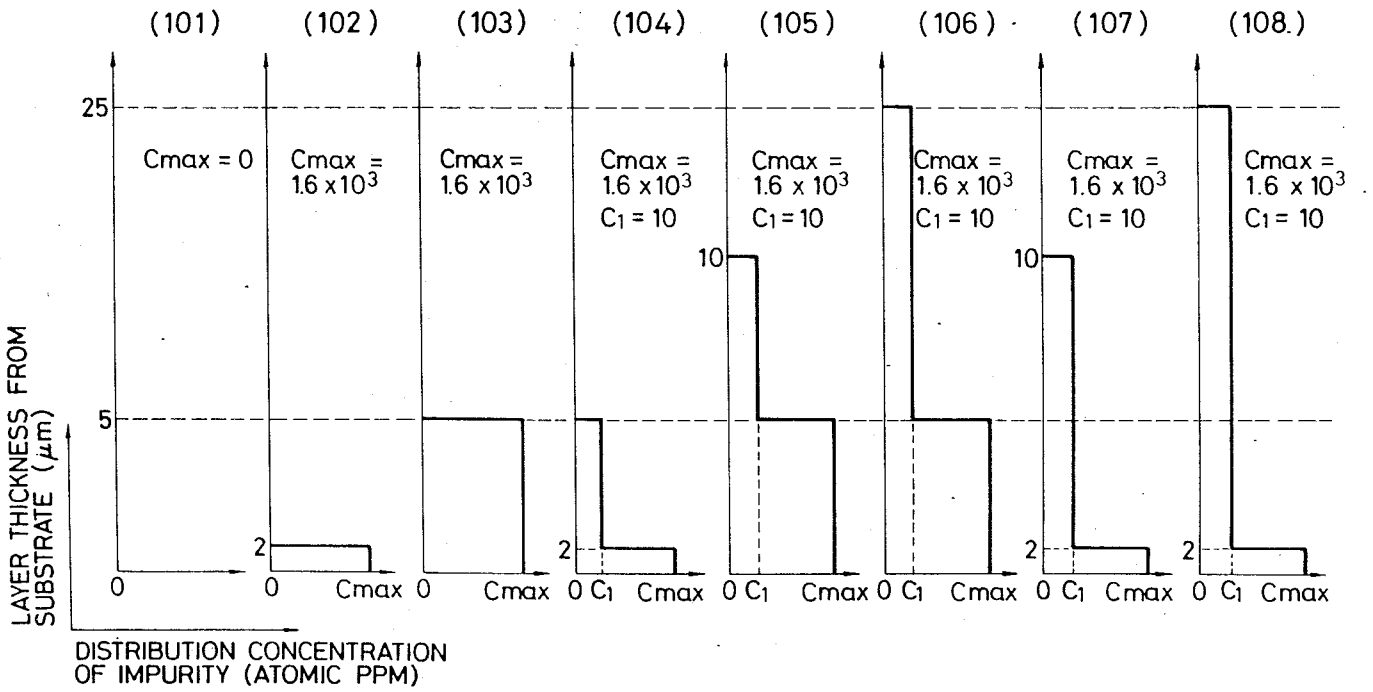
FIG. 14A, 14B and FIG. 16 each shows schematically the concentration distribution of boron atoms in the light-receiving layer in Examples of the light-receiving member of the present invention.
Figure 14B:
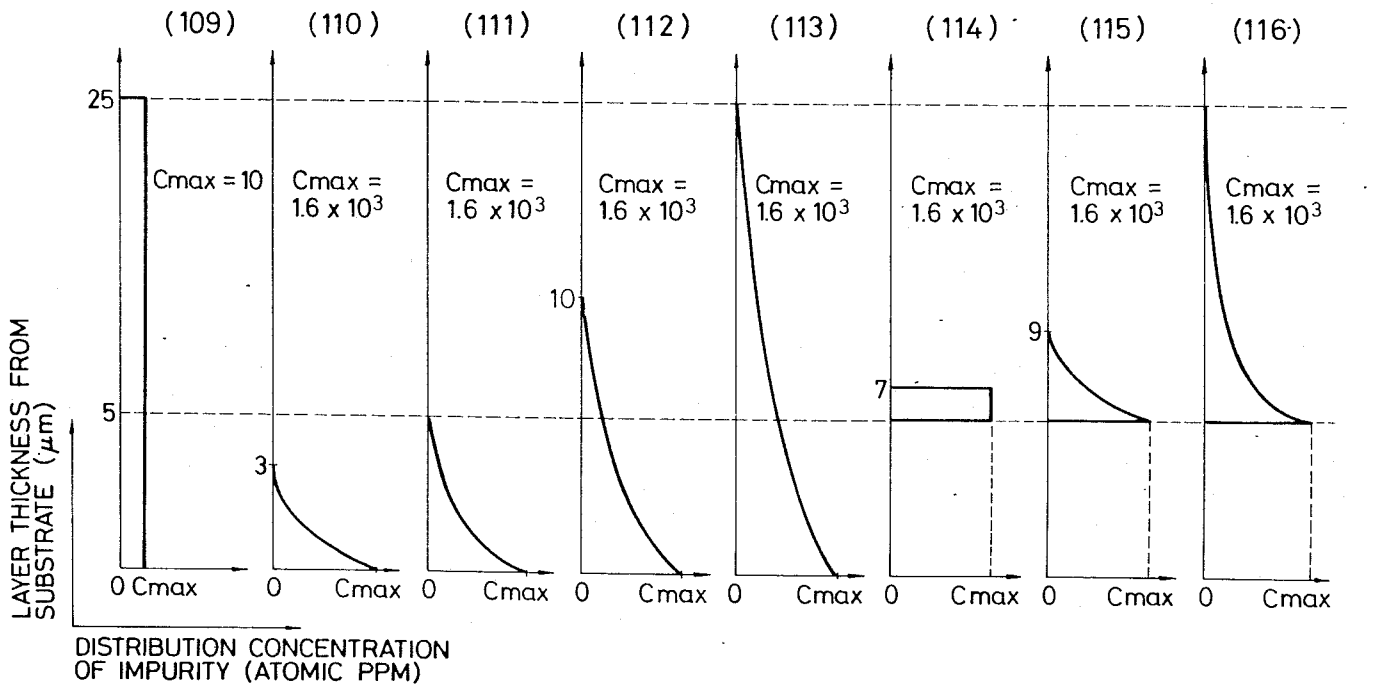
Figure 15:
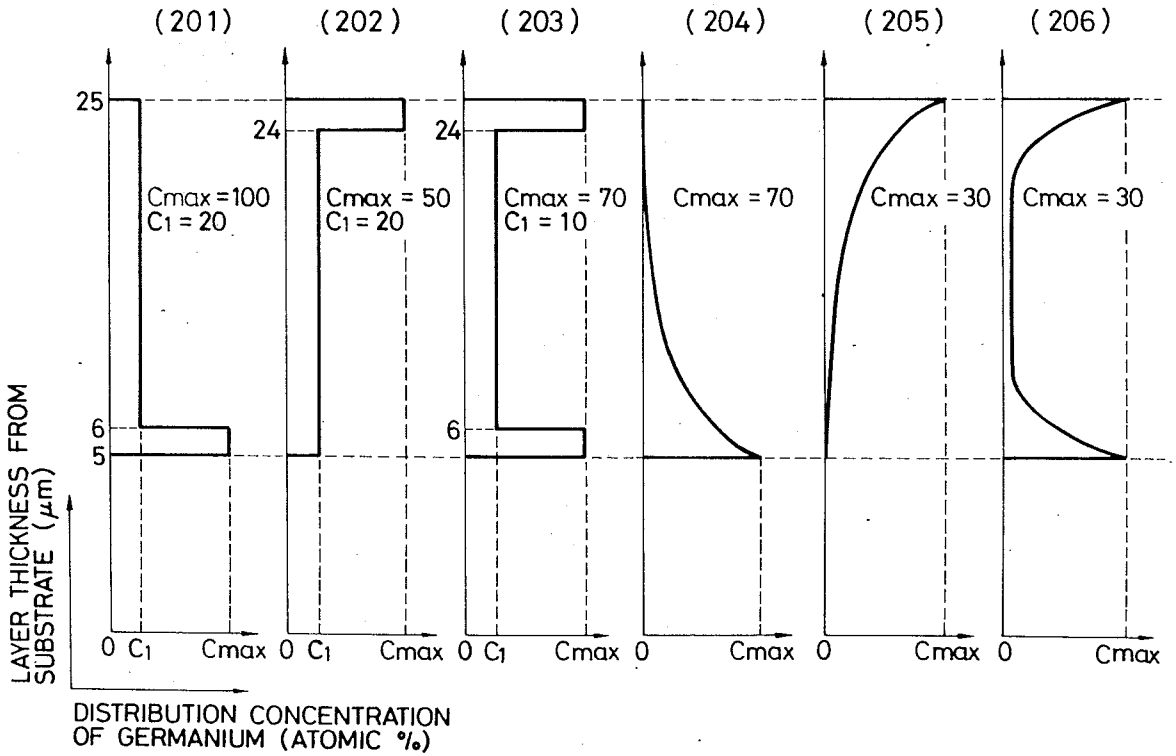
FIG. 15 and FIG. 17 each shows schematically the concentration distribution of germanium atoms in the second layer (II) in Examples of the light-receiving member of the present invention.

The depth profiles of boron atoms and germanium atoms in the light-receiving layers of respective samples are shown in FIG. 14A, FIG. 14B and in FIG. 15, respectively. The depth profiles of boron atoms and germanium atoms in respective samples were formed by controlling the gas flow rates of $B_2H_6$ and $GeF_4$ by automatic operation of opening and closing of the corresponding valves following the change rate curves of the gas flow rates previously determined. Correspondence of the depth profiles of boron atoms and germanium atoms in respective samples to FIGS. 14A, 14B and 15 is listed in Table 2A.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 0.2 lux.sec through a transmission type test chart.

Immediately thereafter, ⊖ chargeable developer (containing toner and carrier) was cascaded on the surface of the image forming member to give a good toner image of ths surface of the image forming member. When the toner image was transferred onto a transfer paper by corona charging of ⊕5.0 KV, a clear image of high density with excellent resolution and good gradation reproducibility was obtained in every image forming member.

Then, the same experiments were repeated under the same toner image forming conditions as described above, except that an electrostatic image was formed by using GaAs type semiconductor laser (10 mW) of 810 nm in place of hte tungsten lamp as the light source, and image quality evaluation of the toner transferred image was performed for each sample. As the result, a clear image of high quality, good in gradation reproducibility, could be obtained in every image forming member.

EXAMPLE 2

By means of the device shown in FIG. 22, respective samples of image forming members for electrophotography (48 Samples of No. 21-1A to 28-6A) were prepared, respectively, on cylindrical aluminum substrates following the same procedure as in Example 1 under the conditions shown in Table 3A.

Figure 16:
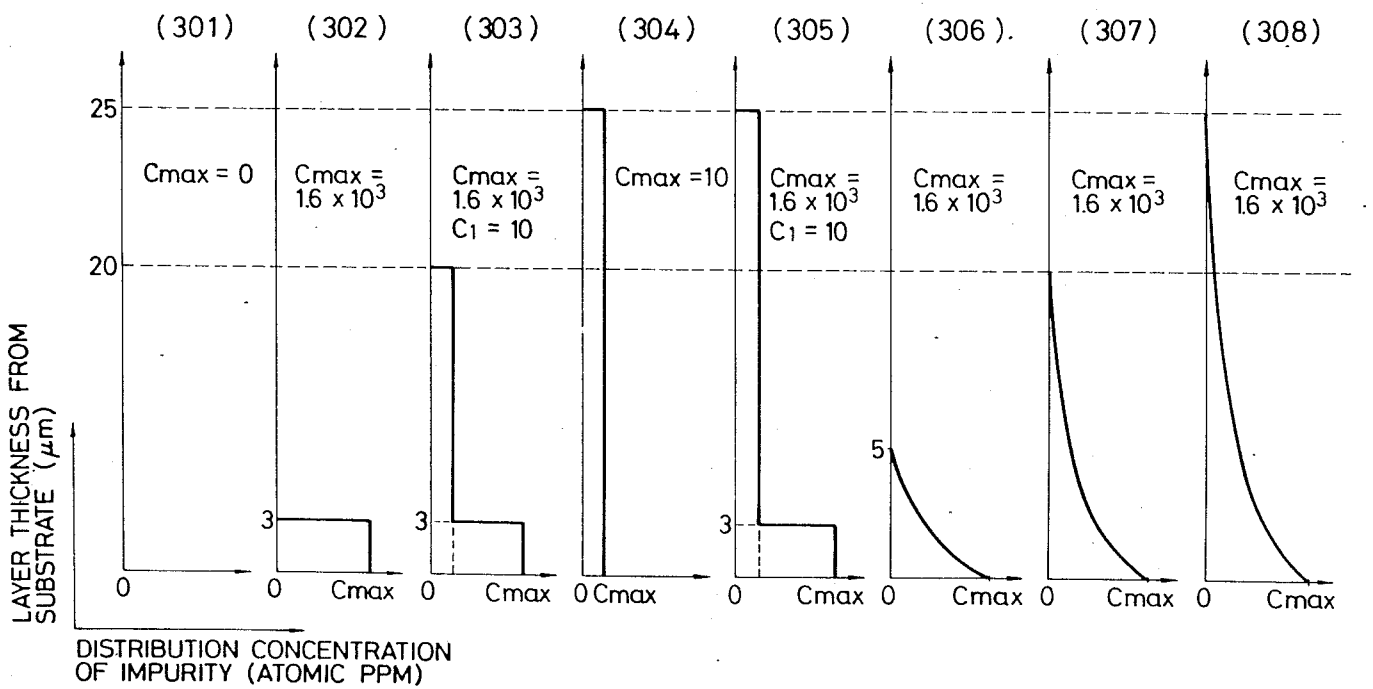
Figure 17:
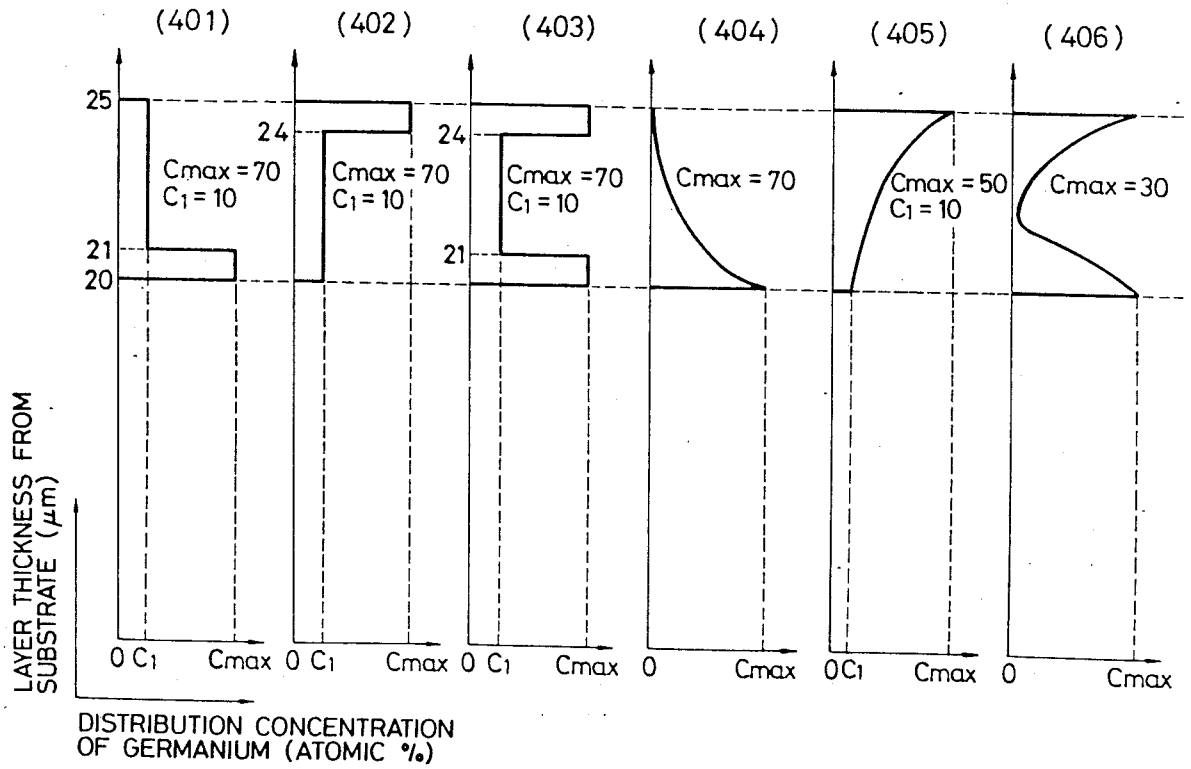

The depth profiles of boron atoms and germanium atoms in the light-receiving layers of respective samples are shown in FIG. 16 and in FIG. 17, respectively. The depth profiles of boron atoms and germanium atoms in respective samples were formed by controlling the gas flow rates of $B_2H_6$ and $GeF_4$ by automatic operation of opening and closing of the corresponding valves following the change rate curves of the gas flow rates previously determined. Correspondence of the depth profiles of boron atoms and germanium atoms in respective samples to FIG. 16 and FIG. 17 is listed in Table 4A.

When image quality evaluation of the toner transferred image was performed similarly as in Example 1 by use of the thus prepared image forming member, images of high quality excellent in resolution and good in gradation reproducibility could be obtained in every image forming member.

EXAMPLE 3

By means of the preparation device of FIG. 22, respective image forming members for electrophotography (24 Samples of Sample No. 12-5-1-A–12-5-8A, 24-4-1A–24-4-8A, 28-2-1A–28-2-8A) were prepared following the same conditions and procedures as employed in preparation of Sample No. 12-5A in Example 1 and Samples No. 24-4A and 28-2A in Example 2, except that the preparation conditions for the third layer (III) were changed to the respective conditions as shown in FIG. 5A.

By using each of the thus prepared image forming members, image quality and durability by repeated continuous usage were evaluated under the same conditions as in Example 1. The evaluation results of these respective samples are shown in Table 6A.

EXAMPLE 4

Except for practicing preparation of the third layer (III) by the sputtering method and varying variously the target area ratio of silicon wafer to silicon nitride wafer and the mixing ratio of Ar to $NH_3$ during its formation to vary the content ratio of silicon atoms to nitrogen atoms in the third layer (III), a light-receiving layer was formed on a cylindrical aluminum substrate similarly as Sample No. 3-1A in Example 1 to prepare image forming members for electrophotography (7 Samples of Sample No. 3-1-1A–3-1-7A).

By using each of the thus prepared image forming members, image formation, developing and cleaning steps were repeated for about 50,000 times similarly as in Example 1, followed by image quality evaluation to obtain the evaluation results in Table 7A.

EXAMPLE 5

During formation of the third layer (III), the flow rate ratio of $SiH_4$ gas to $NH_3$ gas was changed to vary the content ratio of silicon atoms to nitrogen atoms in the third layer (III), otherwise following the same procedure as Sample No. 3-1A in Example 1 to form a light-receiving layer on a cylindrical aluminum substrate, thus preparing image forming members for electrophotography (8 Samples of Sample No. 3-1-11A–3-1-18A).

By using each of the thus prepared image forming members, image formation, developing and cleaning steps were repeated for about 50,000 times similarly as in Example 1, followed by image quality evaluation to obtain the evaluation results in Table 8A.

EXAMPLE 6

During formation of the third layer (III), the flow rate ratios of $SiH_4$ gas, $SiF_4$ gas and $NH_3$ gas were changed to vary the content ratio of silicon atoms to nitrogen atoms in the third layer (III), otherwise following the same procedure as Sample No. 3-1A in Example 1 to form a light-receiving layer on a cylindrical aluminum substrate, thus preparing image forming members for electrophotography (8 Samples of Sample No. 3-1-21A–3-1-28A).

By using each of the thus prepared image forming members, image formation, developing and cleaning steps were repeated for about 50,000 times similarly as in Example 1, followed by image quality evaluation, to obtain the evaluation results shown in Table 9A.

EXAMPLE 7

Following entirely the same procedure as in Sample No. 3-1A in Example 1, except for varying the layer thickness of the third layer (III), light-receiving layer was formed on a cylindrical aluminum substrate to prepare respective image forming members for electrophotography, respectively (4 Samples of Sample No. 3-1-31A–3-1-34A).

By using each of the thus prepared image forming members, image formation, developing and cleaning steps were repeated for about 50,000 times similarly as in Example 1, followed by image quality evaluation, to obtain the evaluation results shown in Table 10A.

EXAMPLE 8

By means of the device for preparation of photoconductive members shown in FIG. 22, light-receiving layers were formed following the preparation conditions shown in Table 1B on aluminum cylinders according to the glow discharge decomposition method as previously described in detail to prepare respective samples of image forming members for electrophotography (960 Samples of Sample No. 1-1B-1–16-10B-6).

Figure 18:
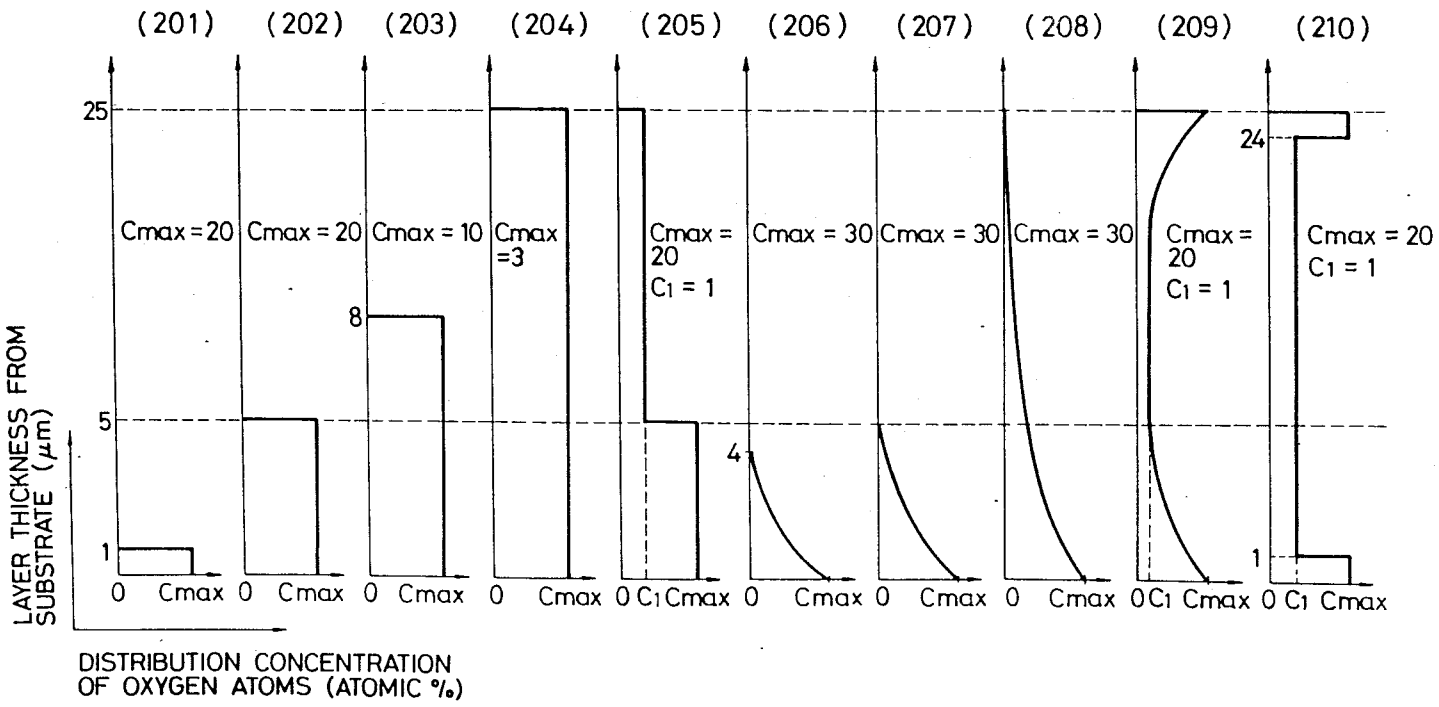
FIG. 18 and FIG. 19 each shows schematically the concentration distribution of oxygen atoms in the light-receiving layer in Examples of the light-receiving member of the present invention.

The depth profiles in respective samples of boron atoms contained in the layer region comprising the first layer (I) and the second layer (II) in the light-receiving layer are shown in FIG. 14A and FIG. 14B, the depth profiles of oxygen atoms in FIG. 18 and further the depth profiles of germanium atoms contained in the second layer (II) in FIG. 15.

The depth profiles of boron atoms, oxygen atoms and germanium atoms in individual samples were represented in terms of the sample No. affixed to respective samples.

That is, the depth profiles of boron atoms and oxygen atoms are represented by the numbers 1-1B–16-10B as shown in Table 3B, and further the depth profiles of germanium atoms were annexed with the numbers of 1 to 6 corresponding to the numbers at the end of the six kinds of depth profiles (201–206) shown in FIG. 15 at the end of the numbers of 1-1B–16-10B shown in Table 3B.

Such depth profiles of boron atoms, oxygen atoms and germanium atoms were formed by controlling the flow rates of $B_2H_6$/He, NO and $GeF_4$/He gases by automatic control of opening and closing of the valves following the change rate curve of gas flow rated previously determined.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 0.2 lux.sec through a transmission type test chart.

Immediately thereafter, ⊖ chargeable developer (containing toner and carrier) was cascaded on the surface of the image forming member to give a good toner image of the surface of the image forming member. When the toner image was transferred onto a transfer paper by corona charging of ⊕5.0 KV, a clear image of high density with excellent resolution and good gradation reproducibility was obtained in every image forming member.

Then, the sample experiments were repeated under the same toner image forming conditions as described above, except that an electrostatic image was formed by using GaAs type semiconductor laser (10 mW) of 810 nm in place of the tungsten lamp as the light source, and image quality evaluation of the toner transferred image was performed for each sample. As the result, a clear image of high quality, good in gradation reproducibility, could be obtained in every image forming member.

EXAMPLE 9

By means of the device shown in FIG. 22, respective samples of image forming members for electrophotography (432 Samples of No. 21-1B-1 to 28-9B-6) were prepared, respectively, on cylindrical aluminum substrates following the same procedures as in Example 8 under the conditions shown in Table 2B.

Figure 19:
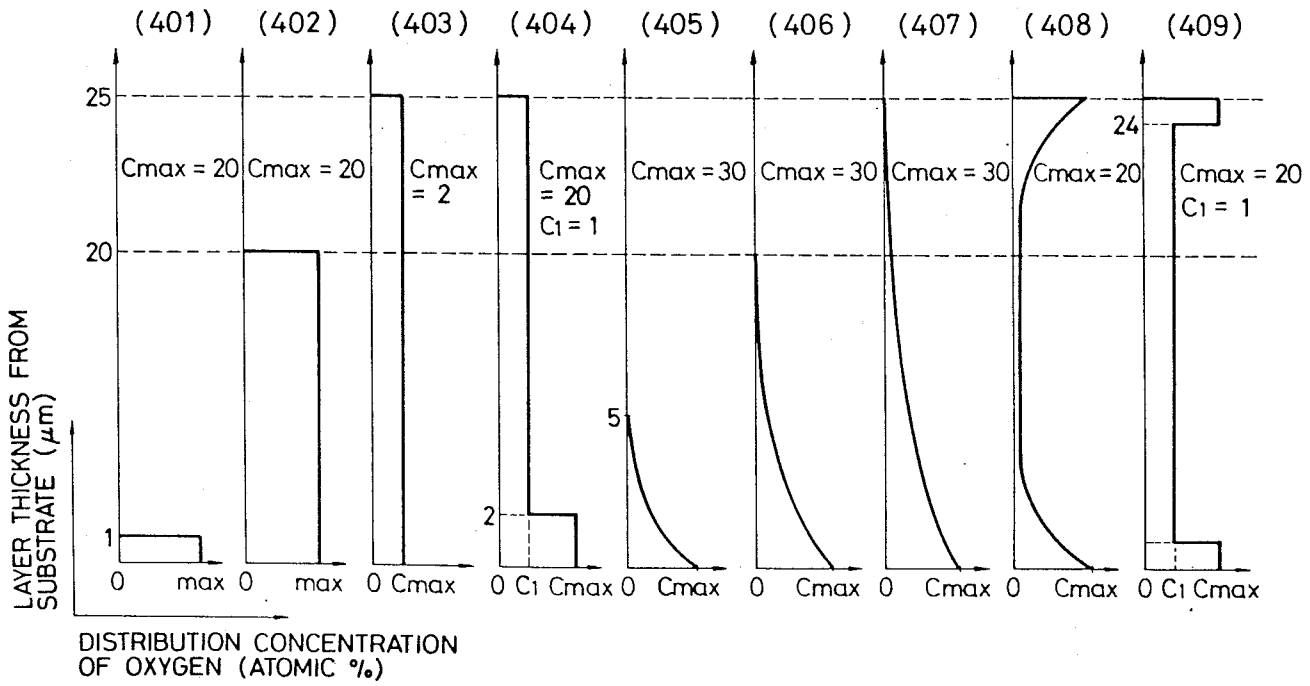

The depth profiles in respective samples of boron atoms contained in the layer region comprising the first layer (I) and the second layer (II) in the light-receiving layer are shown in FIG. 16, the depth profiles of oxygen atoms in FIG. 19 and further the depth profiles of germanium atoms contained in the second layer (II) in FIG. 17.

The depth profiles of boron atoms, oxygen atoms and germanium atoms in individual samples were represented in terms of the sample No. affixed to respective samples similarly as in Example 8.

That is, the depth profiles of boron atoms and oxygen atoms are represented by the numbers 21-1B–28-9B as shown in Table 4B, and further the depth profiles of germanium atoms were annexed with the numbers of 1 to 6 corresponding to the numbers at the end of the six kinds of depth profiles (401–406) shown in FIG. 17 at the end of the numbers of 1-1B–16-10B shown in Table 4B.

When image quality evaluation of the toner transferred image was performed under the same conditions as in Example 8 by use of the thus prepared image forming member, images of high quality excellent in resolution and good in gradation reproducibility could be obtained in every image forming member.

EXAMPLE 10

By means of the preparation device of FIG. 22, respective image forming members (24 Samples of Sample No. 5-5B-2-1–5-5B-2-8, 14-10B-5-1–14-10B-5-8, 25-3B-4-1–25-3B-4-8) were prepared following the same conditions and procedures as employed in preparation of Sample No. 5-5B-2 and 14-10B-5 in Example 8 and Samples No. 25-3B-4 in Example 9, except that the preparation conditions for the third layer (III) were changed to the respective conditions as shown in FIG. 5B.

By using each of the thus prepared image forming members, image quality and durability by repeated continuous usage were evaluated under the same conditions as in Example 8. The evaluation results of these respective samples are shown in Table 6B.

EXAMPLE 11

Except for practicing preparation of the third layer (III) by the sputtering method and varying variously the target area ratio of silicon wafer to silicon nitride wafer during its formation to vary the content ratio of silicon atoms to nitrogen atoms in the third layer (III), a light-receiving layer was formed on a cylindrical aluminum substrate similarly as Sample No. 8-9B-4 in Example 8 to prepare image forming members for electrophotography (7 Samples of Sample No. 8-9B-4-1 to 8-9B-4-7).

By using each of the thus prepared image forming members, image formation, developing and cleaning steps were repeated for about 50,000 times similarly as in Example 8, followed by image quality evaluation to obtain the evaluation results in Table 7B.

EXAMPLE 12

During formation of the third layer (III), the flow rate ratio of $SiH_4$ gas to $NH_3$ gas was changed to vary the content ratio of silicon atoms to nitrogen atoms in the third layer (III), otherwise following the same procedure as Sample No. 8-9B-4 in Example 8 to form a light-receiving layer on a cylindrical aluminum substrate, thus preparing image forming members for electrophotography (8 Samples of Sample No. 8-9B-4-11–8-9B-4-18).

By using each of the thus prepared image forming members, image formation, developing and cleaning steps were repeated for about 50,000 times similarly as in Example 8, followed by image quality evaluation to obtain the evaluation results in Table 8B.

EXAMPLE 13

During formation of the third layer (III), the flow rate ratios of $SiH_4$ gas, $SiF_4$ gas and $NH_3$ gas were changed to vary the content ratio of silicon atoms to nitrogen atoms in the third layer (III), otherwise following the same procedure as Sample No. 8-9B-4 in Example 8 to form a light-receiving layer on a cylindrical aluminum substrate, thus preparing image forming members for electrophotography (8 Samples of Sample No. 8-9B-4-21–8-9B-4-28).

By using each of the thus prepared image forming members, image formation, developing and cleaning steps were repeated for about 50,000 times similarly as in Example 8, followed by image quality evaluation to obtain the evaluation results in Table 9B.

EXAMPLE 14

Following entirely the same procedure as in Sample No. 8-9B-4 in Example 8, except for varying the layer thickness of the third layer (III), light-receiving layer was formed on a cylindrical aluminum substrate to prepare respective image forming members for electrophotography, respectively (4 Samples of Sample No. 8-9B-4-31–8-9B-4-34).

By using each of the thus prepared image forming members, image formation, developing and cleaning steps were repeated for about 50,000 times similarly as in Example 8, followed by image quality evaluation, to obtain the evaluation results shown in Table 10B.

EXAMPLE 15

By means of the device for preparation of photoconductive members shown in FIG. 22, light-receiving layers were formed following the preparation conditions shown in Table 1C on aluminum cylinders according to the glow discharge decomposition method as previously described in detail to prepare respective samples of image forming members for electrophotography (960 Samples of Sample No. 1-1C-1–16-10C-6).

Figure 20:
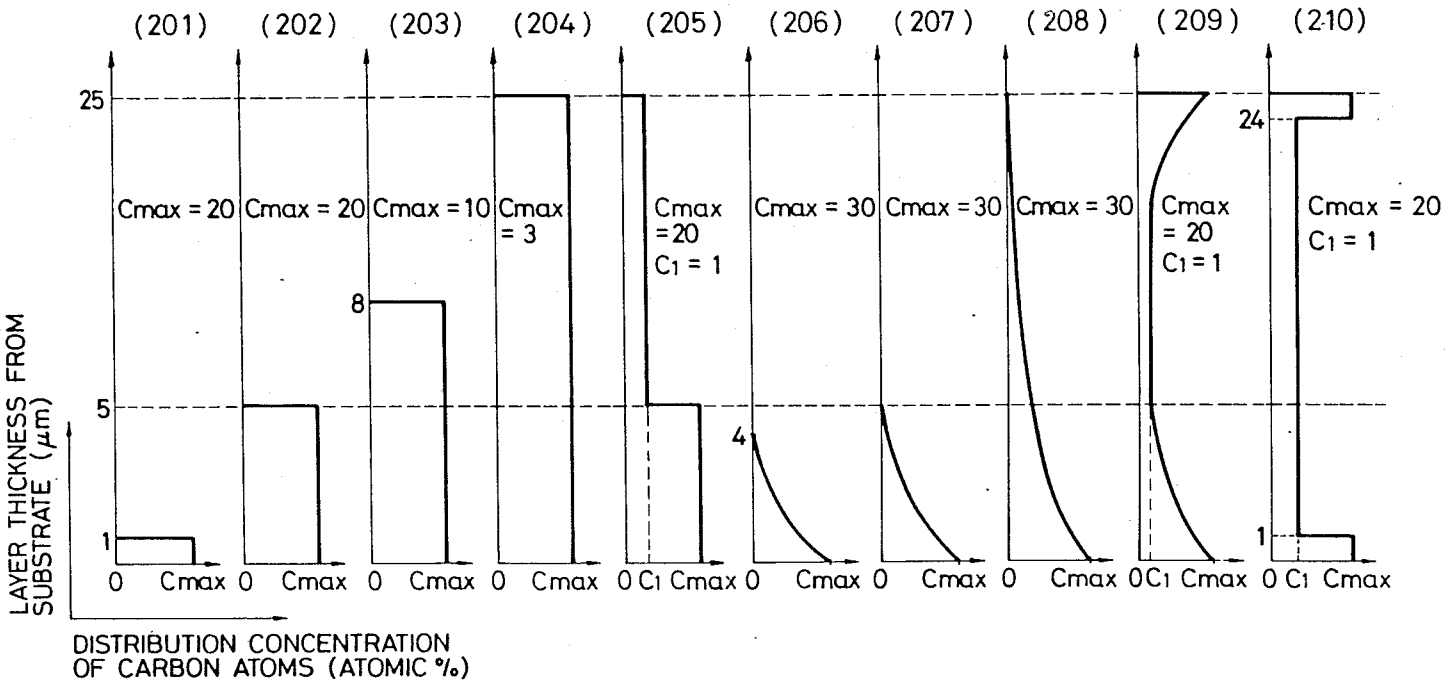
FIG. 20 and FIG. 21 each shows schematically the concentration distribution of carbon atoms in the light-receiving layer in Examples of the photoconductive members of the present invention.

The depth profiles in respective samples of boron atoms contained in the layer region comprising the first layer (I) and the second layer (II) in the light-receiving layer are shown in FIG. 14A and FIG. 14B, the depth profiles of carbon atoms in FIG. 20 and further the depth profiles of germanium atoms contained in the second layer (II) in FIG. 15.

The depth profiles of boron atoms, carbon atoms and germanium atoms in individual samples were represented in terms of the sample No. affixed to respective samples.

That is, the depth profiles of boron atoms and carbon atoms are represented by the numbers 1-1C–16-10C as shown in Table 3C, and further the depth profiles of germanium atoms were annexed with the numbers of 1 to 6 corresponding to the numbers at the end of the six kinds of depth profiles (201–206) shown in FIG. 15 at the end of the numbers of 1-1-C–16-10C shown in Table 3C.

Such depth profiles of boron atoms, carbon atoms and germanium atoms were formed by controlling the flow rates of $B_2H_6$/He, $C_2H_4$ and $GeF_4$/He gases by automatic control of opening and closing of the valves following the change rate curves of gas flow rates previously determined.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 0.2 lux·sec through a transmission type test chart.

Immediately thereafter, ⊖ chargeable developer (containing toner and carrier) was cascaded on the surface of the image forming member to give a good toner image of the surface of the image forming member. When the toner image was transferred onto a transfer paper by corona charging of ⊕5.0 KV, a clear image of high density with excellent resolution and good gradation reproducibility was obtained in every image forming member.

Then, the same experiments were repeated under the same toner image forming conditions as described above, except that an electrostatic image was formed by using GaAs type semiconductor laser (10 mW) of 810 nm in place of the tungsten lamp as the light source, and image quality evaluation of the toner transferred image was performed for each sample. As the result, a clear image of high quality, good in gradation reproducibility, could be obtained in every image forming member.

EXAMPLE 16

By means of the device shown in FIG. 22, respective samples of image forming members for electrophotography (432 Samples of No. 21-1C-1 to 28-9C-6) were prepared, respectively, on cylindrical aluminum substrates following the same procedures as in Example 15 under the conditions shown in Table 2C.

Figure 21:
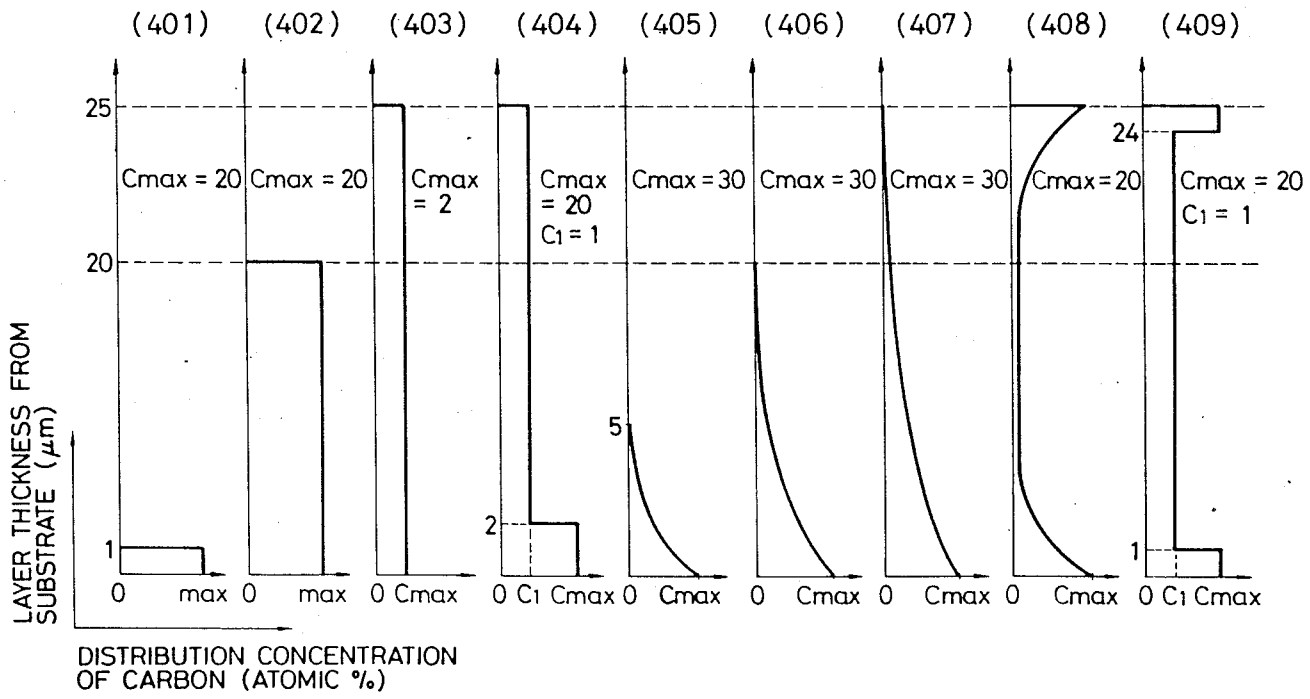

The depth profiles in respective samples of boron atoms contained in the layer region comprising the first layer (I) and the second layer (II) in the light-receiving layer are shown in FIG. 16, the depth profiles of carbon atoms in FIG. 21 and further the depth profiles of germanium atoms contained in the second layer (II) in FIG. 17.

The depth profiles of boron atoms, carbon atoms and germanium atoms in individual samples were represented in terms of the sample No. affixed to respective samples similarly as in Example 15.

That is, the depth profiles of boron atoms and carbon atoms are represented by the numbers 21-1C–28-9C as shown in Table 4C, and further the depth profiles of germanium atoms were annexed with the numbers of 1 to 6 corresponding to the numbers at the end of the six kinds of depth profiles (401–406) shown in FIG. 17 at the end of the numbers of 1-1C–16-10C shown in Table 4C.

When image quality evaluation of the toner transferred image was performed under the same conditions as in Example 15 by use of the thus parepared image forming member, images of high quality excellent in resolution and good in gradation reproducibility could be obtained in every image forming member.

EXAMPLE 17

By means of the preparation device of FIG. 22, respective image forming members (24 Samples of Sample No. 5-5C-2-1–5-5C-2-8, 14-10C-5-1–14-10C-8, 25-3C-4-1–25-3C-4-8) were prepared following the same conditions and procedures as employed in preparation of Sample No. 5-5C-2 and 14-10C-5 in Example 15 and Samples No. 25-3C-4 in Example 16, except that the preparation conditions for the third layer (III) were changed to the respective conditions as shown in FIG. 5C.

By using each of the thus prepared image forming members, image quality and durability by repeated continuous usage were evaluated under the same conditions as in Example 15. The evaluation results of these respective samples are shown in Table 6C.

EXAMPLE 18

Except for practicing preparation of the third layer (III) by the sputtering method and varying variously the target area ratio of silicon wafer to silicon nitraide wafer during its formation to vary the content ratio of silicon atoms to nitrogen atoms in the third layer (III), a light-receiving layer was formed on a cylindrical aluminum substrate similarly as Sample No. 8-9C-4 in Example 15 to prepare image forming members for electrophotography (7 Samples of Sample No. 8-9C-4-1–8-9C-4-7).

By using each of the thus prepared image forming members, image formation, developing and cleaning steps were repeated for about 50,000 times similarly as in Example 15, followed by image quality evaluation to obtain the evaluation results in Table 7C.

EXAMPLE 19

During formation of the third layer (III), the flow rate ratio of $SiH_4$ gas to $NH_3$ gas was changed to vary the content ratio of silicon atoms to nitrogen atoms in the third layer (III), otherwise following the same procedure as Sample No. 8-9C-4 in Example 15 to form a light-receiving layer on a cylindrical aluminum substrate, thus preparing image forming members for electrophotography (8 Samples of Sample No. 8-9C-4-11–8-9C-4-18).

By using each of the thus prepared image forming members, image formation, developing and cleaning steps were repeated for about 50,000 times similarly as in Example 15, followed by image quality evaluation to obtain the evaluation results in Table 8C.

EXAMPLE 20

During formation of the third layer (III), the flow rate ratios of $SiH_4$ gas, $SiF_4$ gas and $NH_3$ gas were changed to vary the content ratio of silicon atoms to nitrogen atoms in the third layer (III), otherwise following the same procedure as Sample No. 8-9C-4 in Example 15 to form a light-receiving layer on a cylindrical aluminum substrate, thus preparing image forming members for electrophotography (8 Samples of Sample No. 8-9C-4-21–8-9C-4-28).

By using each of the thus prepared image forming members, image formation, developing and cleaning steps were repeated for about 50,000 times similarly as in Example 15, followed by image quality evaluation to obtain the evaluation results in Table 9C.

EXAMPLE 21

Following entirely the same procedure as in Sample No. 8-9C-4 in Example 15, except for varying the layer thickness of the third layer (III), light-receiving layer was formed on a cylindrical aluminum substrate to prepare respective image forming members for electrophotography, respectively (4 Samples of Sample No. 8-9C-4-31–8-9C-4-34).

By using each of the thus prepared image forming members, image formation, developing and cleaning steps were repeated for about 50,000 times similarly as in Example 15, followed by image quality evaluation, to obtain the evaluation results shown in Table 10C.

The common layer forming conditions in the above Examples are shown below.

Support temperature:

During formation of the first and the third layers: about 250 ° C.

During formation of the second layer: about 200 ° C.

Discharging frequency: 13.56 MHz

Inner pressure in the reaction chamber during reaction: 0.3 Torr

TABLE 1A

| Layer Constitution | Gases employed | Flow rate (SCCM) | Flow rate ratio | Discharging power ($W/cm^2$) | Layer formation rate (Å/sec) | Layer thickness (μm) |
|---|---|---|---|---|---|---|
| First layer (I) | $SiH_4/He = 0.5$<br>$B_2H_6/Ge = 10^{-5}$ | $SiH_4 = 200$ | | 0.18 | 15 | 5 |
| Second layer (II) | $SiF_4/He = 0.5$<br>$GeF_4/He = 0.5$<br>$H_2$<br>$B_2H_6/He = 10^{-5}$ | $SiF_4 + GeF_4 = 200$ | | 0.18 | 15 | 20 |
| Third layer (III) | $SiH_4/He = 0.5$<br>$NH_3$ | $SiH_4 + 100$ | $SiH_4/NH_3 = 1/30$ | 0.18 | 10 | 0.5 |

TABLE 2A

| Depth profile No. of B | Sample No. | Depth profile No. of Ge 201 | 202 | 203 | 204 | 205 | 206 |
|---|---|---|---|---|---|---|---|
| 101 | | 1-1A | 1-2A | 1-3A | 1-4A | 1-5A | 1-6A |
| 102 | | 2-1A | 2-2A | 2-3A | 2-4A | 2-5A | 2-6A |
| 103 | | 3-1A | 3-2A | 3-3A | 3-4A | 3-5A | 3-6A |
| 104 | | 4-1A | 4-2A | 4-3A | 4-4A | 4-5A | 4-6A |
| 105 | | 5-1A | 5-2A | 5-3A | 5-4A | 5-5A | 5-6A |
| 106 | | 6-1A | 6-2A | 6-3A | 6-4A | 6-5A | 6-6A |
| 107 | | 7-1A | 7-2A | 7-3A | 7-4A | 7-5A | 7-6A |
| 108 | | 8-1A | 8-2A | 8-3A | 8-4A | 8-5A | 8-6A |
| 109 | | 9-1A | 9-2A | 9-3A | 9-4A | 9-5A | 9-6A |
| 110 | | 10-1A | 10-2A | 10-3A | 10-4A | 10-5A | 10-6A |
| 111 | | 11-1A | 11-2A | 11-3A | 11-4A | 11-5A | 11-6A |
| 112 | | 12-1A | 12-2A | 12-3A | 12-4A | 12-5A | 12-6A |
| 113 | | 13-1A | 13-2A | 13-3A | 13-4A | 13-5A | 13-6A |
| 114 | | 14-1A | 14-2A | 14-3A | 14-4A | 14-5A | 14-6A |
| 115 | | 15-1A | 15-2A | 15-3A | 15-4A | 15-5A | 15-6A |
| 116 | | 16-1A | 16-2A | 16-3A | 16-4A | 16-5A | 16-6A |

TABLE 3A

| Layer Constitution | Gases employed | Flow rate (SCCM) | Flow rate ratio | Discharging power ($W/cm^2$) | Layer formation rate (Å/sec) | Layer thickness (μm) |
|---|---|---|---|---|---|---|
| First layer (I) | $SiH_4/He = 0.5$<br>$B_2H_6/He = 10^{-5}$ | $SiH_4 = 200$ | | 0.18 | 15 | 20 |
| Second layer (II) | $SiF_4/He = 0.5$<br>$GeF_4/He = 0.5$<br>$H_2$<br>$B_2H_6/He = 10^{-5}$ | $SiF_4 + GeF_4 = 200$ | | 0.18 | 15 | 5 |
| Third layer (III) | $SiH_4/He = 0.5$<br>$NH_3$ | $SiH_4 = 100$ | $SiH_4/NH_3 = 1/30$ | 0.18 | 10 | 0.5 |

TABLE 4A

| Depth profile No. of B | Sample No. | Depth profile No. of Ge 401 | 402 | 403 | 404 | 405 | 406 |
|---|---|---|---|---|---|---|---|
| 301 | | 21-1A | 21-2A | 21-3A | 21-4A | 21-5A | 21-6A |
| 302 | | 22-1A | 22-2A | 22-3A | 22-4A | 22-5A | 22-6A |
| 303 | | 23-1A | 23-2A | 23-3A | 23-4A | 23-5A | 23-6A |
| 304 | | 24-1A | 24-2A | 24-3A | 24-4A | 24-5A | 24-6A |
| 305 | | 25-1A | 25-2A | 25-3A | 25-4A | 25-5A | 25-6A |
| 306 | | 26-1A | 26-2A | 26-3A | 26-4A | 26-5A | 26-6A |
| 307 | | 27-1A | 27-2A | 27-3A | 27-4A | 27-5A | 27-6A |
| 308 | | 28-1A | 28-2A | 28-3A | 28-4A | 28-5A | 28-6A |

TABLE 5A

| Conditions | Gases employed | Flow rate (SCCM) | Flow rate ratio or Area ratio | Discharging power ($W/cm^2$) | Layer thickness ($\mu m$) |
|---|---|---|---|---|---|
| 1 | $Ar(NH_3/Ar)$ | 200 (1/1) | Si wafer:Silicon nitride = 1:30 | 0.3 | 0.5 |
| 2 | $Ar(NH_3/Ar)$ | 200 (1/1) | Si wafer:Silicon nitride = 1:30 | 0.3 | 0.3 |
| 3 | $Ar(NH_3/Ar)$ | 200 (1/1) | Si wafer:Silicon nitride = 1:30 | 0.3 | 1.0 |
| 4 | $SiH_4/He = 1$<br>$NH_3$ | $SiH_4 = 150$ | $SiH_4:NH_3 = 1:100$ | 0.18 | 0.3 |
| 5 | $SiH_4/He = 0.5$<br>$NH_3$ | $SiH_4 = 100$ | $SiH_4:NH_3 = 1:30$ | 0.18 | 1.5 |
| 6 | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 7 | $SiH_4/He = 0.5$<br>$SiF_4/He = 0.5$<br>$NH_3$ | $SiH_4 + SiF_4 = 150$ | $SiH_4:SiF_4:NH_3 = 2:1:90$ | 0.18 | 0.3 |
| 8 | $SiH_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE 6A

| Layer (III) forming conditions | Sample No./Evaluation | | |
|---|---|---|---|
| 1 | 12-5-1A<br>○ ○ | 24-4-1A<br>○ ○ | 28-2-1A<br>○ ○ |
| 2 | 12-5-2A<br>○ ○ | 24-4-2A<br>○ ○ | 28-2-2A<br>○ ○ |
| 3 | 12-5-3A<br>○ ○ | 24-4-3A<br>○ ○ | 28-2-3A<br>○ ○ |
| 4 | 12-5-4A<br>◎ ◎ | 24-4-4A<br>◎ ◎ | 28-2-4A<br>◎ ◎ |
| 5 | 12-5-5A<br>◎ ◎ | 24-4-5A<br>◎ ◎ | 28-2-5A<br>◎ ◎ |
| 6 | 12-5-6A<br>◎ ◎ | 24-4-6A<br>◎ ◎ | 28-2-6A<br>◎ ◎ |

TABLE 6A-continued

| | | | |
|---|---|---|---|
| 7 | 12-5-7A<br>○ ○ | 24-4-7A<br>○ ○ | 28-2-7A<br>○ ○ |
| 8 | 12-5-8A<br>○ ○ | 24-4-8A<br>○ ○ | 28-2-8A<br>○ ○ |
| Sample No. | | | |
| Overall image quality evalution | Durability evaluation | | |

Evaluation standards:
◎. . . Excellent
○ . . . Good

TABLE 7A

| Sample No. | 3-1-1A | 3-1-2A | 3-1-3A | 3-1-4A | 3-1-5A | 3-1-6A | 3-1-7A |
|---|---|---|---|---|---|---|---|
| $Si:Si_3N_4$ Target (Area ratio) ($NH_3/Ar$) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality evalution | Δ | ◎ | ◎ | ○ | ○ | Δ | X |

◎: Very good
○ : Good
Δ: Sufficiently practically usable
X: Image defect formed

TABLE 8A

| Sample. No. | 3-1-11A | 3-1-12A | 3-1-13A | 3-1-14A | 3-1-15A | 3-1-16A | 3-1-17A | 3-1-18A |
|---|---|---|---|---|---|---|---|---|
| $Si:NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 4.5:5.5 | 4.5:5.5 | 4:6 | 3.5:6.5 |
| Image quality evaluation | Δ | ◎ | ◎ | ◎ | ○ | Δ | Δ | X |

◎: Very good
○ : Good
Δ: Sufficiently practically usable
X: Image defect formed

TABLE 9A

| Sample No. | 3-1-21A | 3-1-22A | 3-1-23A | 3-1-24A | 3-1-25A | 3-1-26A | 3-1-27A | 3-1-28A |
|---|---|---|---|---|---|---|---|---|
| $SiH_4$:$SiF_4$:$NH_3$ (Flow rate ratio) | 5:4:1 | 1:1:6 | 1:1:20 | 1:1:60 | 1:1:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○ : Good
Δ: Sufficiently practically usable
X: Image defect formed

TABLE 10A

| Sample No. | Thickness of layer (III) (μm) | Results |
|---|---|---|
| 3-1-31A | 0.001 | Image defect liable to occur |
| 3-1-32A | 0.02 | No image defect formed up to successive copying for 20,000 times |

TABLE 10A-continued

| Sample No. | Thickness of layer (III) (μm) | Results |
|---|---|---|
| 3-1-33A | 0.05 | Stable up to successive copying for 50,000 times |
| 3-1-34A | 1 | Stable up to successive copying for 200,000 times |

TABLE 1B

| Layer constitution | Gases employed | Flow rate (SCCM) | Flow rate ratio | Discharging power (W/cm$^2$) | Layer formation rate (Å/sec) | Layer thickness (μm) |
|---|---|---|---|---|---|---|
| First layer (I) | $SiH_4$/He = 0.5<br>$B_2H_6$/He = $10^{-3}$<br>NO | $SiH_4$ = 200 | | 0.18 | 15 | 5 |
| Second layer (II) | $SiF_4$/He = 0.5<br>$GeF_4$/He = 0.5<br>$B_2H_6$/He = $10^{-3}$<br>$H_2$<br>NO | $SiF_4$ + $GeF_4$ = 200 | | 0.18 | 15 | 20 |
| Third layer (III) | $SiH_4$/He = 0.5<br>$NH_3$ | $SiH_4$ = 100 | $SiH_4/NH_3$ = 1/30 | 0.18 | 10 | 0.5 |

TABLE 2B

| Layer constitution | Gases employed | Flow rate (SCCM) | Flow rate ratio | Discharging power (W/cm$^2$) | Layer formation rate (Å/sec) | Layer thickness (μm) |
|---|---|---|---|---|---|---|
| First layer (I) | $SiH_4$/He = 0.5<br>$B_2H_6$/He = $10^{-3}$<br>NO | $SiH_4$ = 200 | | 0.18 | 15 | 20 |
| Second layer (II) | $SiF_4$/He = 0.5<br>$GeF_4$/He = 0.5<br>$B_2H_6$/He = $10^{-3}$<br>$H_2$<br>NO | $SiF_4$ + $GeF_4$ = 200 | | 0.18 | 15 | 5 |
| Third layer (III) | $SiH_4$/He = 0.5<br>$NH_3$ | $SiH_4$ = 100 | $SiH_4/NH_3$ = 1/30 | 0.18 | 10 | 0.5 |

TABLE 3B

| Depth profile No. of B | Sample No | Depth profile No. of O | | | | | | | | | |
|---|---|---|---|---|---|---|---|---|---|---|---|
| | | 201 | 202 | 203 | 204 | 205 | 206 | 207 | 208 | 209 | 210 |
| 101 | | 1-1B | 1-2B | 1-3B | 1-4B | 1-5B | 1-6B | 1-7B | 1-8B | 1-9B | 1-10B |
| 102 | | 2-1B | 2-2B | 2-3B | 2-4B | 2-5B | 2-6B | 2-7B | 2-8B | 2-9B | 2-10B |
| 103 | | 3-1B | 3-2B | 3-3B | 3-4B | 3-5B | 3-6B | 3-7B | 3-8B | 3-9B | 3-10B |
| 104 | | 4-1B | 4-2B | 4-3B | 4-4B | 4-5B | 4-6B | 4-7B | 4-8B | 4-9B | 4-10B |
| 105 | | 5-1B | 5-2B | 5-3B | 5-4B | 5-5B | 5-6B | 5-7B | 5-8B | 5-9B | 5-10B |
| 106 | | 6-1B | 6-2B | 6-3B | 6-4B | 6-5B | 6-6B | 6-7B | 6-8B | 6-9B | 6-10B |
| 107 | | 7-1B | 7-2B | 7-3B | 7-4B | 7-5B | 7-6B | 7-7B | 7-8B | 7-9B | 7-10B |
| 108 | | 8-1B | 8-2B | 8-3B | 8-4B | 8-5B | 8-6B | 8-7B | 8-8B | 8-9B | 8-10B |
| 109 | | 9-1B | 9-2B | 9-3B | 9-4B | 9-5B | 9-6B | 9-7B | 9-8B | 9-9B | 9-10B |
| 110 | | 10-1B | 10-2B | 10-3B | 10-4B | 10-5B | 10-6B | 10-7B | 10-8B | 10-9B | 10-10B |
| 111 | | 11-1B | 11-2B | 11-3B | 11-4B | 11-5B | 11-6B | 11-7B | 11-8B | 11-9B | 11-10B |
| 112 | | 12-1B | 12-2B | 12-3B | 12-4B | 12-5B | 12-6B | 12-7B | 12-8B | 12-9B | 12-10B |
| 113 | | 13-1B | 13-2B | 13-3B | 13-4B | 13-5B | 13-6B | 13-7B | 13-8B | 13-9B | 13-10B |
| 114 | | 14-1B | 14-2B | 14-3B | 14-4B | 14-5B | 14-6B | 14-7B | 14-8B | 14-9B | 14-10B |
| 115 | | 15-1B | 15-2B | 15-3B | 15-4B | 15-5B | 15-6B | 15-7B | 15-8B | 15-9B | 15-10B |

TABLE 3B-continued

| Depth profile No. of B | Sample No | Depth profile No. of O | | | | | | | | | |
|---|---|---|---|---|---|---|---|---|---|---|---|
| | | 201 | 202 | 203 | 204 | 205 | 206 | 207 | 208 | 209 | 210 |
| 116 | | 16-1B | 16-2B | 16-3B | 16-4B | 16-5B | 16-6B | 16-7B | 16-8B | 16-9B | 16-10B |

TABLE 4B

| Depth profile No. of B | Sample No | Depth profile No. of O | | | | | | | | |
|---|---|---|---|---|---|---|---|---|---|---|
| | | 401 | 402 | 403 | 404 | 405 | 406 | 407 | 408 | 409 |
| 301 | | 21-1B | 21-2B | 21-3B | 21-4B | 21-5B | 21-6B | 21-7B | 21-8B | 21-9B |
| 302 | | 22-1B | 22-2B | 22-3B | 22-4B | 22-5B | 22-6B | 22-7B | 22-8B | 22-9B |
| 303 | | 23-1B | 23-2B | 23-3B | 23-4B | 23-5B | 23-6B | 23-7B | 23-8B | 23-9B |
| 304 | | 24-1B | 24-2B | 24-3B | 24-4B | 24-5B | 24-6B | 24-7B | 24-8B | 24-9B |
| 305 | | 25-1B | 25-2B | 25-3B | 25-4B | 25-5B | 25-6B | 25-7B | 25-8B | 25-9B |
| 306 | | 26-1B | 26-2B | 26-3B | 26-4B | 26-5B | 26-6B | 26-7B | 26-8B | 26-9B |
| 307 | | 27-1B | 27-2B | 27-3B | 27-4B | 27-5B | 27-6B | 27-7B | 27-8B | 27-9B |
| 308 | | 28-1B | 28-2B | 28-3B | 28-4B | 28-5B | 28-6B | 28-7B | 28-8B | 28-9B |

TABLE 5B

| Conditions | Gases employed | Flow rate (SCCM) | Flow rate ratio or Area ratio | Discharging power (W/sec) | Layer thickness (μm) |
|---|---|---|---|---|---|
| 1 | $Ar(NH_3/Ar)$ | 200 (1/1) | Si wafer:Silicon nitride = 1:30 | 0.3 | 0.5 |
| 2 | $Ar(NH_3/Ar)$ | 200 (1/1) | Si wafer:Silicon nitride = 1:60 | 0.3 | 0.3 |
| 3 | $Ar(NH_3/Ar)$ | 200 (1/1) | Si wafer:Silicon nitride = 6:4 | 0.3 | 1.0 |
| 4 | $SiH_4/He = 1$<br>$NH_3$ | $SiH_4 = 150$ | $SiH_4:NH_3 = 1:100$ | 0.18 | 0.3 |
| 5 | $SiH_4/He = 0.5$<br>$NH_3$ | $SiH_4 = 100$ | $SiH_4:NH_3 = 1:30$ | 0.18 | 1.5 |
| 6 | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 7 | $SiH_4/He = 0.5$<br>$SiF_4/He = 0.5$<br>$NH_3$ | $SiH_4 + SiF_4 = 150$ | $SiH_4:SiF_4:NH_3 = 2:1:90$ | 0.18 | 0.3 |
| 8 | $SiH_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE 6B

| Layer (III) forming conditons | Sample No./Evaluation | | |
|---|---|---|---|
| 1 | 5-5B-2-1<br>○ ○ | 14-10B-5-1<br>○ ○ | 25-3B-4-1<br>○ ○ |
| 2 | 5-5B-2-1<br>○ ○ | 14-10B-5-2<br>○ ○ | 25-3B-4-2<br>○ ○ |
| 3 | 5-5B-2-3<br>○ ○ | 14-10B-5-3<br>○ ○ | 25-3B-4-3<br>○ ○ |
| 4 | 5-5B-2-4<br>◎ ◎ | 14-10B-5-4<br>◎ ◎ | 25-3B-4-4<br>◎ ◎ |
| 5 | 5-5B-2-5<br>◎ ◎ | 14-10B-5-5<br>◎ ◎ | 25-3B-4-5<br>◎ ◎ |
| 6 | 5-5B-2-6<br>◎ ◎ | 14-10B-5-6<br>◎ ◎ | 25-3B-4-6<br>◎ ◎ |

TABLE 6B-continued

| | | | |
|---|---|---|---|
| 7 | 5-5B-2-7<br>○ ○ | 14-10B-5-7<br>○ ○ | 25-3B-4-7<br>○ ○ |
| 8 | 5-5B-2-8<br>○ ○ | 12-10B-5-8<br>○ ○ | 25-3B-4-8<br>○ ○ |

| Sample No. | |
|---|---|
| Overall image quality evaluation | Durability evaluation |

Evaluation standards:
◎ . . . Excellent
○ . . . Good

TABLE 7B

| Sample No. | 8-9B-4-1 | 8-9B-4-2 | 8-9B-4-3 | 8-9B-4-4 | 8-9B-4-5 | 8-9B-4-6 | 8-9B-4-7 |
|---|---|---|---|---|---|---|---|
| $Si:Si_3N_4$ Target (Area ratio) ($NH_3/Ar$) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○ : Good
Δ: Sufficiently practically usable
X: Image defect formed

TABLE 8B

| Sample No. | 8-9B-4-11 | 8-9B-4-12 | 8-9B-4-13 | 8-9B-4-14 | 8-9B-4-15 | 8-9B-4-16 | 8-9B-4-17 | 8-9B-4-18 |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |

TABLE 8B-continued

| Sample No. | 8-9B-4-11 | 8-9B-4-12 | 8-9B-4-13 | 8-9B-4-14 | 8-9B-4-15 | 8-9B-4-16 | 8-9B-4-17 | 8-9B-4-18 |
|---|---|---|---|---|---|---|---|---|
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | ⊙ | ⊙ | ⊙ | ○ | Δ | Δ | X |

⊙: Very good
○ : Good
Δ: Sufficiently practically usable
X: Image defect formed

TABLE 9B

| Sample No. | 8-9B-4-21 | 8-9B-4-22 | 8-9B-4-23 | 8-9B-4-24 | 8-9B-4-25 | 8-9B-4-26 | 8-9B-4-27 | 8-9B-4-28 |
|---|---|---|---|---|---|---|---|---|
| $SiH_4$:$SiF_4$:$NH_3$ (Flow rate ratio) | 5:4:1 | 1:1:6 | 1:1:20 | 1:1:60 | 1:1:300 | 2:1:3000 | 1:1:10000 | 1:1:20000 |
| Si:N (Content ratio) | 9.99:0.01 | 9.8:0.2 | 8.4:1.6 | 7.0:3.0 | 5.1:4.9 | 4.6:5.4 | 4.1:5.9 | 3.6:6.4 |
| Image quality evaluation | Δ | ⊙ | ⊙ | ⊙ | ○ | Δ | Δ | X |

⊙: Very good
○ : Good
Δ: Sufficiently practically usable
X: Image defect formed

TABLE 10B

| Sample No. | Thickness of layer(III) (μm) | Results |
|---|---|---|
| 8-9B-4-31 | 0.001 | Image defect liable to occur |
| 8-9B-4-32 | 0.02 | No image defect formed up to successive copying for 20,000 times |

TABLE 10B-continued

| Sample No. | Thickness of layer(III) (μm) | Results |
|---|---|---|
| 8-9B-4-33 | 0.05 | Stable up to successive copying for 50,000 times |
| 8-9B-4-34 | 1 | Stable up to successive copying for 200,000 times |

TABLE 1C

| Layer constitution | Gases employed | Flow rate (SCCM) | Flow rate ratio | Discharging power (W/cm$^2$) | Layer formation rate (Å/sec) | Layer thickness (μm) |
|---|---|---|---|---|---|---|
| First layer (I) | $SiH_4$/He = 0.5<br>$B_2H_6$/He = $10^{-3}$<br>$C_2H_4$ | $SiH_4$ = 200 | | 0.18 | 15 | 5 |
| Second layer (II) | $SiF_4$/He = 0.5<br>$GeF_4$/He = 0.5<br>$B_2H_6$/He = $10^{-3}$<br>$H_2$<br>$C_2H_4$ | $SiF_4$ + $GeF_4$ = 200 | | 0.18 | 15 | 20 |
| Third layer (III) | $SiH_4$/He = 0.5<br>$NH_3$ | $SiH_4$ = 100 | $SiH_4$/$NH_3$ = 1/30 | 0.18 | 10 | 0.5 |

TABLE 2C

| Layer constitution | Gases employed | Flow rate (SCCM) | Flow rate ratio | Discharging power (W/cm$^2$) | Layer formation rate (Å/sec) | Layer thickness (μm) |
|---|---|---|---|---|---|---|
| First layer (I) | $SiH_4$/He = 0.5<br>$B_2H_6$/He = $10^{-3}$<br>$C_2H_4$ | $SiH_4$ = 200 | | 0.18 | 15 | 20 |
| Second layer (II) | $SiF_4$/He = 0.5<br>$GeF_4$/He = 0.5<br>$B_2H_6$/He = $10^{-3}$<br>$H_2$<br>$C_2H_4$ | $SiF_4$ + $GeF_4$ = 200 | | 0.18 | 15 | 5 |
| Third layer (III) | $SiH_4$/He = 0.5<br>$NH_3$ | $SiH_4$ = 100 | $SiH_4$/$NH_3$ = 1/30 | 0.18 | 10 | 0.5 |

TABLE 3C

| | | Depth profile No. of C | | | | | | | | | |
|---|---|---|---|---|---|---|---|---|---|---|---|
| Depth profile No. of B | Sample No | 201 | 202 | 203 | 204 | 205 | 206 | 207 | 208 | 209 | 210 |
| 101 | | 1-1C | 1-2C | 1-3C | 1-4C | 1-5C | 1-6C | 1-7C | 1-8C | 1-9C | 1-10C |
| 102 | | 2-1C | 2-2C | 2-3C | 2-4C | 2-5C | 2-6C | 2-7C | 2-8C | 2-9C | 2-10C |
| 103 | | 3-1C | 3-2C | 3-3C | 3-4C | 3-5C | 3-6C | 3-7C | 3-8C | 3-9C | 3-10C |

TABLE 3C-continued

| Depth profile No. of B | Sample No | Depth profile No. of C | | | | | | | | | |
|---|---|---|---|---|---|---|---|---|---|---|---|
| | | 201 | 202 | 203 | 204 | 205 | 206 | 207 | 208 | 209 | 210 |
| 104 | | 4-1C | 4-2C | 4-3C | 4-4C | 4-5C | 4-6C | 4-7C | 4-8C | 4-9C | 4-10C |
| 105 | | 5-1C | 5-2C | 5-3C | 5-4C | 5-5C | 5-6C | 5-7C | 5-8C | 5-9C | 5-10C |
| 106 | | 6-1C | 6-2C | 6-3C | 6-4C | 6-5C | 6-6C | 6-7C | 6-8C | 6-9C | 6-10C |
| 107 | | 7-1C | 7-2C | 7-3C | 7-4C | 7-5C | 7-6C | 7-7C | 7-8C | 7-9C | 7-10C |
| 108 | | 8-1C | 8-2C | 8-3C | 8-4C | 8-5C | 8-6C | 8-7C | 8-8C | 8-9C | 8-10C |
| 109 | | 9-1C | 9-2C | 9-3C | 9-4C | 9-5C | 9-6C | 9-7C | 9-8C | 9-9C | 9-10C |
| 110 | | 10-1C | 10-2C | 10-3C | 10-4C | 10-5C | 10-6C | 10-7C | 10-8C | 10-9C | 10-10C |
| 111 | | 11-1C | 11-2C | 11-3C | 11-4C | 11-5C | 11-6C | 11-7C | 11-8C | 11-9C | 11-10C |
| 112 | | 12-1C | 12-2C | 12-3C | 12-4C | 12-5C | 12-6C | 12-7C | 12-8C | 12-9C | 12-10C |
| 113 | | 13-1C | 13-2C | 13-3C | 13-4C | 13-5C | 13-6C | 13-7C | 13-8C | 13-9C | 13-10C |
| 114 | | 14-1C | 14-2C | 14-3C | 14-4C | 14-5C | 14-6C | 14-7C | 14-8C | 14-9C | 14-10C |
| 115 | | 15-1C | 15-2C | 15-3C | 15-4C | 15-5C | 15-6C | 15-7C | 15-8C | 15-9C | 15-10C |
| 116 | | 16-1C | 16-2C | 16-3C | 16-4C | 16-5C | 16-6C | 16-7C | 16-8C | 16-9C | 16-10C |

TABLE 4C

| Depth profile No. of B | Sample No. | Depth profile No. of C | | | | | | | | |
|---|---|---|---|---|---|---|---|---|---|---|
| | | 401 | 402 | 403 | 404 | 405 | 406 | 407 | 408 | 409 |
| 301 | | 21-1C | 21-2C | 21-3C | 21-4C | 21-5C | 21-6C | 21-7C | 21-8C | 21-9C |
| 302 | | 22-1C | 22-2C | 22-3C | 22-4C | 22-5C | 22-6C | 22-7C | 22-8C | 22-9C |
| 303 | | 23-1C | 23-2C | 23-3C | 23-4C | 23-5C | 23-6C | 23-7C | 23-8C | 23-9C |
| 304 | | 24-1C | 24-2C | 24-3C | 24-4C | 24-5C | 24-6C | 24-7C | 24-8C | 24-9C |
| 305 | | 25-1C | 25-2C | 25-3C | 25-4C | 25-5C | 25-6C | 25-7C | 25-8C | 25-9C |
| 306 | | 26-1C | 26-2C | 26-3C | 26-4C | 26-5C | 26-6C | 26-7C | 26-8C | 26-9C |
| 307 | | 27-1C | 27-2C | 27-3C | 27-4C | 27-5C | 27-6C | 27-7C | 27-8C | 27-9C |
| 308 | | 28-1C | 28-2C | 28-3C | 28-4C | 28-5C | 28-6C | 28-7C | 28-8C | 28-9C |

TABLE 5C

| Conditions | Gases employed | Flow rate (SCCM) | Flow rate ratio or Area ratio | Discharging power ($W/cm^2$) | Layer thickness (μm) |
|---|---|---|---|---|---|
| 1 | $Ar(NH_3/Ar)$ | 200 (1/1) | Si wafer:Silicon nitride = 1:30 | 0.3 | 0.5 |
| 2 | $Ar(NH_3/Ar)$ | 200 (1/1) | Si wafer:Silicon nitride = 1:60 | 0.3 | 0.3 |
| 3 | $Ar(NH_3/Ar)$ | 200 (1/1) | Si wafer:Silicon nitride = 6:4 | 0.3 | 1.0 |
| 4 | $SiH_4/He = 1$ $NH_3$ | $SiH_4 = 150$ | $SiH_4:NH_3 = 1:100$ | 0.18 | 0.3 |
| 5 | $SiH_4/He = 0.5$ $NH_3$ | $SiH_4 = 100$ | $SiH_4:NH_3 = 1:30$ | 0.18 | 1.5 |
| 6 | $SiH_4/He = 0.5$ $SiF_4/He = 0.5$ $NH_3$ | $SiH_4 + SiF_4 = 150$ | $SiH_4:SiF_4:NH_3 = 1:1:60$ | 0.18 | 0.5 |
| 7 | $SiH_4/He = 0.5$ $SiF_4/He = 0.5$ $NH_3$ | $SiH_4 + SiF_4 = 150$ | $SiH_4:SiF_4:NH_3 = 2:1:90$ | 0.18 | 0.3 |
| 8 | $SiH_4/He = 0.5$ $SiF_4/He = 0.5$ $NH_3$ | $SiH_4 + SiF_4 = 150$ | $SiH_4:SiF_4:NH_3 = 1:1:20$ | 0.18 | 1.5 |

TABLE 6C

| Layer (III) forming conditions | Sample No./Evaluation | | |
|---|---|---|---|
| 1 | 5-5C-2-1 ○ ○ | 14-10C-5-1 ○ ○ | 25-3C-4-1 ○ ○ |
| 2 | 5-5C-2-2 ○ ○ | 14-10C-5-2 ○ ○ | 25-3C-4-2 ○ ○ |
| 3 | 5-5C-2-3 ○ ○ | 14-10C-5-3 ○ ○ | 25-3C-4-3 ○ ○ |
| 4 | 5-5C-2-4 ◎ ◎ | 14-10C-5-4 ◎ ◎ | 25-3C-4-4 ◎ ◎ |
| 5 | 5-5C-2-5 ◎ ◎ | 14-10C-5-5 ◎ ◎ | 25-3C-4-5 ◎ ◎ |
| 6 | 5-5C-2-6 ◎ ◎ | 14-10C-5-6 ◎ ◎ | 25-3C-4-6 ◎ ◎ |

TABLE 6C-continued

| | | | |
|---|---|---|---|
| 7 | 5-5C-2-7 ○ ○ | 14-10C-5-7 ○ ○ | 25-3C-4-7 ○ ○ |
| 8 | 5-5C-2-8 ○ ○ | 14-10C-5-8 ○ ○ | 25-3C-4-8 ○ ○ |

| Sample No. | Overall image quality evaluation | Durability evaluation |
|---|---|---|

Evaluation standards:
◎...Excellent
○ ...Good

TABLE 7C

| Sample No. | 8-9C-4-1 | 8-9C-4-2 | 8-9C-4-3 | 8-9C-4-4 | 8-9C-4-5 | 8-9C-4-6 | 8-9C-4-7 |
|---|---|---|---|---|---|---|---|
| $Si:Si_3N_4$ Target (Area ratio) ($NH_3/Ar$) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |

TABLE 7C-continued

| Sample No. | 8-9C-4-1 | 8-9C-4-2 | 8-9C-4-3 | 8-9C-4-4 | 8-9C-4-5 | 8-9C-4-6 | 8-9C-4-7 |
|---|---|---|---|---|---|---|---|
| Image quality evaluation | Δ | ◎ | ◎ | ○ | ○ | Δ | X |

◎:Very good
○ :Good
Δ:Sufficiently practically usable
X: Image defect formed

TABLE 8C

| Sample No. | 8-9C-4-11 | 8-9C-4-12 | 8-9C-4-13 | 8-9C-4-14 | 8-9C-4-15 | 8-9C-4-16 | 8-9C-4-17 | 8-9C-4-18 |
|---|---|---|---|---|---|---|---|---|
| $SiH_4$:$NH_3$ (Flow rate ratio) | 9:1 | 1:3 | 1:10 | 1:30 | 1:100 | 1:1000 | 1:5000 | 1:10000 |
| Si:N (Content ratio) | 9:99:0.01 | 9.9:0.1 | 8.5:1.5 | 7.1:2.9 | 5:5 | 4.5:5.5 | 4:6 | 3.5:6.5 |
| Image quality evaluation | Δ | ◎ | ◎ | ◎ | ○ | Δ | Δ | X |

◎:Very good
○ :Good
Δ:Sufficiently practically usable
X: Image defect formed

TABLE 9C

| Sample No. | 8-9C-4-21 | 8-9C-4-22 | 8-9C-4-23 | 8-9C-4-24 | 3-9C-4-25 | 8-9C-4-26 | 8-9C-4-27 | 8-9C-4-28 |
|---|---|---|---|---|---|---|---|---|
| $SiH_4$:$SiF_4$:$NH_3$ (Flow rate ratio) | 5:4:1 | 1:1:6 | 1:1:20 | 1:1:60 | 1:1:300 | 2:1:3000 | 1:1:10000 | 1:1:20000 |
| Si:N (Content ratio) | 9.99:0.01 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎:Very good
○ :Good
Δ:Sufficiently practically usable
X:Image defect formed

TABLE 10C

| Sample No. | Thickness of layer (III) (μm) | Results |
|---|---|---|
| 8-9C-4-31 | 0.001 | Image defect liable to occur |
| 8-9C-4-32 | 0.02 | No image defect formed up to successive copying for 20,000 times |
| 8-9C-4-33 | 0.05 | Stable up to successive copying for 50,000 times |
| 8-9C-4-34 | 1 | Stable up to successive copying for 200,000 times |

What we claim is:

1. A light-receiving member comprising a substrate for a light-receiving member and a light-receiving layer having photoconductivity provided on said substrate, said light-receiving layer comprising from the side of said substrate a first layer (I) comprising an amorphous material containing silicon atoms and 1–40 atomic % of at least one of hydrogen atoms and halogen atoms, a second layer (II) comprising an amorphous material containing silicon atoms and $1-9.5\times10^5$ atomic ppm of germanium atoms and 0.01–40 atomic % of at least one of hydrogen atoms and halogen atoms and a third layer (III) comprising an amorphous material containing silicon atoms and 0.001–60 atomic % of nitrogen atoms, and having a layer thickness of 0.003–30 μm, and the germanium atoms contained in said second layer (II) being distributed ununiformly in the layer thickness direction of said layer.

2. A light-receiving member according to claim 1, wherein a substance for controlling conductivity is contained in at least one of the first layer (I) and the second layer (II).

3. A light-receiving member according to claim 1, wherein a substance for controlling conductivity is contained in at least one of the first layer (I) and the second layer (II).

4. A light-receiving member according to claim 2, wherein the substance for controlling conductivity is an atom belonging to the group III of the periodic table.

5. A light-receiving member according to claim 3, wherein the substance for controlling conductivity is an atom belonging to the group III of the periodic table.

6. A light-receiving member according to claim 2, wherein the substance for controlling conductivity is an atom belonging to the group V of the periodic table.

7. A light-receiving member according to claim 3, wherein the substance for controlling conductivity is an atom belonging to the group V of the periodic table.

8. A light-receiving member according to claim 1, wherein at least one of oxygen atoms and carbon atoms are contained in at least one of the first layer (I) and the second layer (II).

9. A light-receiving member according to claim 2, wherein the distribution of the substance for controlling conductivity in a layer region (PN) containing the substance is uniform in the layer thickness direction.

10. A light-receiving member according to claim 2, wherein the distribution of the substance for controlling conductivity in a layer region (PN) containing the substance is ununiform in the layer thickness direction.

11. A light-receiving member according to claim 1, wherein the first layer (I) has a layer region (PN) containing a substance for controlling conductivity.

12. A light-receiving member according to claim 11, wherein the content of the substance for controlling conductivity in the layer region (PN) is 0.001 to $5\times10^4$ atomic ppm.

13. A light-receiving layer according to claim 11, wherein the layer region (PN) is provided in the end portion layer region of the first layer (I) on the substrate side.

14. A light-receiving layer according to claim 11, wherein the layer region (PN) comprises the entire layer region of the first layer (I).

15. A light-receiving layer according to claim 11, wherein there is provided a layer region (Z) containing the substance for controlling conductivity in a content different from that of the substance for controlling conductivity contained in the layer region (PN) in contact with the layer region (PN).

16. A light-receiving member accoring to claim 15, wherein the content of the substance for cotrolling conductivity contained in the layer region (Z) is 0.001 to 1000 atomic ppm.

17. A light-receiving member according to claim 1, wherein the second layer (II) contains a layer region (PN) containing a substance for controlling conductivity.

18. A light-receiving member according to claim 17, wherein the content of the substance for controlling conductivity in the layer region (PN) is 0.001 to $5\times10^4$ atomic ppm.

19. A light-receiving layer according to claim 17, wherein the layer region (PN) is provided in the end portion layer region of the second layer (II) on the substrate side.

20. A light-receiving layer according to claim 17, wherein the layer region (PN) comprises the entire layer region of the first layer (I).

21. A light-receiving layer according to claim 17, wherein there is provided a layer region (Z) containing the substance for controlling conductivity in a content different from that of the substance for controlling conductivity contained in the layer region (PN) in contact with the layer region (PN).

22. A light-receiving member according to claim 21, wherein the content of the substance for controlling conductivity contained in the layer region (Z) is 0.001 to 1000 atomic ppm.

23. A light-receiving member according to claim 1, wherein the layer thickness of the first layer (I) is smaller than the layer thickness of the second layer (II).

24. A light-receiving member according to claim 1, wherein the layer thickness of the first layer (I) is bigger than the layer thickness of the second layer (II).

25. A light-receiving member according to claim 1, wherein the first layer (I) has the function as a charge-generating layer.

26. A light-receiving member according to claim 1, wherein the first layer (I) has the function as a charge-transport layer.

27. A light-receiving member according to claim 1, wherein the second layer (II) has the function as a charge-generating layer.

28. A light-receiving member according to claim 1, wherein the second layer (II) has the function as a charge-transport layer.

29. A light-receiving member according to claim 1, wherein the first layer (I) has a thickness of 1000 Å to 50 μm.

30. A light-receiving member according to claim 1, wherein the second layer (II) has a thickness of 1000 Å to 50 μm.

31. A light-receiving member according to claim 1, wherein the first layer (I) contains at least one of oxygen atoms and carbon atoms.

32. A light-receiving member according to claim 1, wherein the second layer (II) contains at least one of oxygen atoms and carbon atoms.

33. A light-receiving member according to claim 1, wherein the first layer (I) has a layer region (OC) containing 0.001–50 atomic % of oxygen atoms.

34. A light-receiving member according to claim 1, wherein the first layer (I) has a layer region (OC) containing 0.001–50 atomic % of carbon atoms.

35. A light-receiving member according to claim 1, wherein the first layer (I) has the layer region (OC) containing 0.001–50 atomic % of the sum of the content of oxygen atoms and carbon atoms.

36. A light-receiving member according to claim 1, wherein the second layer (II) has a layer region (OC) containing 0.001–50 atomic % of oxygen atoms.

37. A light-receiving member according to claim 1, wherein the second layer (II) has a layer region (OC) containing 0.001–50 atomic % of carbon atoms.

38. A light-receiving member according to claim 1, wherein the second layer (II) has the layer region (OC) containing 0.001–50 atomic % of the sum of the content of oxygen atoms and carbon atoms.

39. A light-receiving layer according to claim 33, wherein the layer region (OC) is provided in the end portion layer region of the first layer (I) on the substrate side.

40. A light-receiving layer according to claim 34, wherein the layer region (OC) is provided in the end portion layer region of the first layer (I) on the substrate side.

41. A light-receiving layer according to claim 35, wherein the layer region (OC) is provided in the end portion layer region of the first layer (I) on the substrate side.

42. A light-receiving layer according to claim 36, wherein the layer region (OC) is provided in the end portion layer region of the second layer (II) on the substrate side.

43. A light-receiving layer according to claim 37, wherein the layer region (OC) is provided in the end portion layer region of the second layer (II) on the substrate side.

44. A light-receiving layer according to claim 38, wherein the layer region (OC) is provided in the end portion layer region of the second layer (II) on the substrate side.

45. A light-receiving layer according to claim 33, wherein the layer region (OC) comprises the entire layer region of the first layer (I).

46. A light-receiving layer according to claim 34, wherein the laeyr region (OC) comprises the entire layer region of the first layer (I).

47. A light-receiving layer according to claim 35, wherein the layer region (OC) comprises the entire layer region of the first layer (I).

48. A light-receiving layer according to claim 36, wherein the layer region (OC) comprises the entire layer region of the second layer (II).

49. A light-receiving layer according to claim 37, wherein the layer region (OC) comprises the entire layer region of the second layer (II).

50. A light-receiving layer according to claim 38, wherein the layer region (OC) comprises the entire layer region of the second layer (II).

51. A light-receiving member according to claim 1, wherein an amorphous material contained in the third layer (III) is selected from the amorphous materials as represented by the following general formulae $Si_aN_{1-a}$ $(0.4 \leqq a \leqq 0.99999)$ $$(Si_bN_{1-b})_cH_{1-c}\begin{pmatrix} 0.45 \leqq b \leqq 0.99999 \\ 0.6 \leqq c \leqq 0.99 \end{pmatrix}$$

-continued $$(Si_dN_{1-d})_e(H,X)_{1-e}\begin{pmatrix} 0.4 \leqq d \leqq 0.99999 \\ 0.8 \leqq e \leqq 0.99 \end{pmatrix}$$

* * * * *

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Col. 1, Line 16, "solid state" should read --solid-state--.

Line 24, "solid state" should read --solid-state--.

Line 25, "pick-up" should read --pickup--.

Line 56, "so called" should read --so-called--.

Col. 2, Line 2, "sufficient" should read --sufficiently--.

Line 33, "based results" should read --based on results--.

Line 37, "solid state" should read --solid-state--.

Line 37, "pick-up" should read --pickup--.

Col. 3, Line 55, "(2)" should read --(II)--.

Col. 5, Line 11, "so called" should read --so-called--.

Line 27, Delete "be".

Line 55, "a" should read --an--.

Col. 6, Line 19, "so called" should read --so-called--.

Line 24, "so called" should read --so-called--.

Line 68, "silicon" should read --silicons--.

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Col. 7, Line 2, "so called" should read --so-called--.

Line 58, Delete "be" (first occurrance).

Line 66, "5X104" should read --$5X10^4$--.

Col. 8, Line 15, "suitable" should read --suitably--.

Line 35, "an" should read --a--.

Line 53, "Layre" should read --layer--.

Line 62, "seocnd" should read --second--.

Line 68, "$t_T$side" should read --$t_T$ side--.

Col. 9, Line 62, "$c_{19}$" should read --$C_{19}$--.

Col. 10, Line 21, "concentration enriched" should read --concentration is enriched--.

Line 22, "FIGS. 1" should read --FIGS. 11--.

Line 64, "$1X10^4$" should read --$1X10^4$--.

Col. 11, Line 13, "(I)has" should read --(I) has--.

Line 30, "a" should read --an--.

Col. 12, Line 4, Delete "the" (second occurrence).

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Col. 13, Line 8, "seocnd" should read --second--.

Line 31, "atoms(X)," should read --atoms (X),--.

Line 57, "atoms(X)" should read --atoms (X)--.

Col. 14, Line 53, "II a" should read --(II), a--.

Line 54, "atoms a" should read --atoms, a--.

Col. 15, Line 22, "atoms(N)," should read --atoms (N),--.

Line 54, "seocnd" should read --second--.

Line 61, "atom(N)," should read --atom (N),--.

Line 61, "atom(H)," should read --atom (H)--.

Col. 16, Line 31, "so called" should read --so-called--.

Col. 17, Line 8, "atomsphere" should read --atmosphere--.

Line 13, "atoms(X)," should read --atoms (X),--.

Line 27, "discharge as" should read --discharge method as"--.

Line 33, "so called" should read --so-called--.

Line 53, "behaviours" should read --behaviour--.

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Line 57, "racterisctics" should read --racteristics--.

Line 61, "light" should read --light--.

Col. 18, Line 4, "effective" should read --effectively--.

Line 8, "be" should read --from--.

Line 24, Delete "5".

Line 29, "pressura" should read --pressure--.

Line 55, "(herein after" should read --(hereinafter--.

Line 61, "optinally" should read --optionally--.

Col. 19, Line 8, "30 to 40" is --1 to 40--.

Line 19, "the content of nitrogen atams may preferably" Delete italics.

Line 20, "be" Delete italics.

Line 28, "of" should read --or--.

Line 31, "is in" should read --is, in--.

Line 31, "representatioin" should read --representation--.

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Line 32, "It should preferably be" Delete italics.

Line 50, "of" (second occurrence) should read --or--.

Col. 20, Line 60, "plural of" should read --plural number of--.

Line 68, Delete "the".

Col. 21, Line 2, "such the " should read --such as the--.

Col. 22, Line 9, "a" should read --the--.

Line 27, "(H) constituent" should read --(H) as constituent--.

Line 28, "(Si) constituent" should read --(Si) as constituent--.

Line 41, "trioxide," should read --Trioxide ($NO_3$),--

Line 66, accoriding" should read --according--.

Col. 23, Line 16, "(x)" should read --(X)--.

Line 57, Query: "and/or atoms" or --and/or carbon atoms--.

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Col. 24, Line 67, "into" should read --in--.

Col. 25, Line 52, "substrate" should read --substrates--.

Col. 26, Line 13, "hadling" should read --handling--.

Line 15, Delete "it".

Line 15, Delete "from".

Line 30, "mexber" should read --member--.

Line 49, "$SiF_4$/Hc gas)," should read --"$SiF_4$/Hc"),--

Line 51, "$B_2H_6$/Hc)" should read --$B_2H_6$/Hc")--.

Line 53, "$NH_3$/Hc)." should read --"$NH_3$/He").--.

Col. 27, Line 34, "Mass flow" should read --mass-flow--.

Col. 28, Line 37, "ths" should read --the--.

Line 47, "hte" should read --the--.

Col. 30, Line 55, "rated" should read --rates--.

Col. 31, Line 54, "Sample" should read --Samples--.

Line 55, "Samples" should read --Sample--.

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Col. 33, Line 18, "1-1-C" should read --1-1C--.

Col. 34, Line 13, "parepared" should read --prepared--.

Line 21, "14-10C-8," should read --14-10C-5-8,--.

Line 24, "Sample" should read --Samples--.

Line 25, "Samples" should read --Sample--.

Line 39, "Nitraide" should read --nitride--.

UNITED STATES PATENT AND TRADEMARK OFFICE

CERTIFICATE OF CORRECTION

PATENT NO. : 4,666,807

DATED : May 19, 1987

INVENTOR(S) : KEISHI SAITOH, ET AL.

It is certified that error appears in the above-identified patent and that said Letters Patent is hereby corrected as shown below:

Col. 35, Tbl. 1A, "(II)$H_2$" should read --II $H_2$--.

Col. 41, Tbl. 6B, "conditions" should read --conditions--.

Tbl. 6B, "5-5B-2-1 should read --5-5B-2-1
0 0 0 0
5-5B-2-1" 5-5B-2-2--.

Col. 42, Tbl. 6B, "12-10B-5-8" should read --14-10B-5-8--.

Col. 48, Tbl. 9C, "3-9C-4-25" should read --8-9C-4-25--.

Signed and Sealed this

Fifteenth Day of December, 1987

*Attest:*

DONALD J. QUIGG

*Attesting Officer*

*Commissioner of Patents and Trademarks*